US012662881B2

(12) United States Patent
Hendrickson

(10) Patent No.: US 12,662,881 B2
(45) Date of Patent: Jun. 23, 2026

(54) COMPACT PORTABLE ROCK DRILL SYSTEM

(71) Applicant: MINNICH MANUFACTURING COMPANY, INC., Mansfield, OH (US)

(72) Inventor: Dustin Hendrickson, Mansfield, OH (US)

(73) Assignee: MINNICH MANUFACTURING COMPANY, INC., Mansfield, OH (US)

( * ) Notice: Subject to any disclaimer, the term of this patent is extended or adjusted under 35 U.S.C. 154(b) by 0 days.

(21) Appl. No.: 18/666,703

(22) Filed: May 16, 2024

(65) Prior Publication Data

US 2025/0354439 A1 Nov. 20, 2025

(51) Int. Cl.
*E21B 7/02* (2006.01)

(52) U.S. Cl.
CPC ..... *E21B 7/022* (2013.01); *E21B 7/027* (2013.01)

(58) Field of Classification Search
CPC ..... B25D 17/28; B25D 17/32; B23B 45/00
See application file for complete search history.

(56) References Cited

U.S. PATENT DOCUMENTS 1,185,809 A * 6/1916 Levin ..... E21B 7/02 248/676
2,293,396 A * 8/1942 Mathews ..... E21B 15/04 173/187
3,116,936 A * 1/1964 Magarian ..... A01D 67/00 280/47.24
3,302,730 A * 2/1967 Bellsmith ..... E21B 7/028 173/28
3,912,024 A * 10/1975 Richmond ..... E21B 19/086 175/122
4,161,988 A 7/1979 Hart
4,422,619 A * 12/1983 Griffiths ..... B66C 13/18 318/563
4,809,788 A 3/1989 Nelson et al.
(Continued)

FOREIGN PATENT DOCUMENTS

CN 100400752 C * 7/2008
CN 108386131 A * 8/2018
(Continued)

OTHER PUBLICATIONS

Minnich Concrete Vibrators & Dowel Pin Drills; The Hornet Sheet; 2013.
(Continued)

*Primary Examiner* — Jennifer H Gay
(74) *Attorney, Agent, or Firm* — Vorys, Sater, Seymour and Pease LLP; Rex W. Miller, II

(57) ABSTRACT

A system includes a utility chassis for use with rock drills for automatic and safe drilling of target surfaces. The system includes a remote control unit that is pneumatically coupled to the system and may be selectively detached from the utility chassis so that the operator may control the system via the remote control unit from afar. The utility chassis has a lightweight vertical frame member with an off-set wheel base that allows the system to maintain its balance and maintain engagement with the ground when while being operated remotely and without being manually supported.

17 Claims, 25 Drawing Sheets

(56) References Cited

U.S. PATENT DOCUMENTS

| | | | | |
|---|---|---|---|---|
| 5,435,399 | A * | 7/1995 | Peterson | E21B 25/005 175/203 |
| 5,667,021 | A | 9/1997 | Bailey et al. | |
| 6,050,345 | A | 4/2000 | Jarvinen et al. | |
| 8,240,682 | B2 | 8/2012 | Kennard | |
| 9,151,116 | B1 * | 10/2015 | Galvez | E21B 19/084 |
| 9,844,868 | B1 | 12/2017 | Abbey et al. | |
| 10,487,583 | B2 * | 11/2019 | Jurjevic | E21B 7/028 |
| 2007/0256845 | A1 * | 11/2007 | Catalano | A01B 1/243 172/21 |
| 2015/0000890 | A1 * | 1/2015 | Adelsbach | F03G 7/04 166/57 |
| 2017/0321489 | A1 * | 11/2017 | Jurjevic | E21B 7/025 |

FOREIGN PATENT DOCUMENTS

| | | | | |
|---|---|---|---|---|
| KR | 20230055173 | A * | 4/2023 | E21B 7/02 |
| WO | WO-0020323 | A1 * | 4/2000 | B66F 15/00 |
| WO | WO-2008026974 | A1 * | 3/2008 | B25H 1/0064 |
| WO | WO-2009051522 | A1 * | 4/2009 | B25H 1/0064 |
| WO | WO-2009051523 | A1 * | 4/2009 | B25H 1/0064 |
| WO | WO-2010059084 | A1 * | 5/2010 | B25H 1/0064 |
| WO | WO-2013004997 | A2 * | 1/2013 | B62B 3/02 |

OTHER PUBLICATIONS

A-1-24 UTL/A-1-30 UTL Specifications Sheet; Form: MM-A-1-UTL Revised Jun. 28, 2011.

* cited by examiner

COMPACT PORTABLE ROCK DRILL SYSTEM

BACKGROUND OF THE INVENTION

The present invention relates generally to the design and configuration of mechanical devices, and more specifically to a compact and ergonomic rock drill utility chassis for more convenient, safe, and comfortable use of various sized rock drills.

Rock drills are often used by utility companies, transportation personnel, and private construction and maintenance companies to perform various tasks such as drilling holes for testing purposes in natural gas infrastructure, road, sidewalk, and tarmac maintenance and construction, and many other circumstances requiring access and structure holes in solid materials. The typical rock drill is operated by compressed air motive force, supplied by an associated high-capacity air compressor. Drills driven by electric and hydraulic motors are also available, for instance. A variety of drills are available, either being entirely hand-held, supported by a semi-portable chassis system, or mounted to mobile equipment. In certain applications, the rock drill is attached to a boom, for instance the boom of a back hoe or excavator, either directly or through a specially configured chassis.

In most situations, the use of a rock drill as a hand-held implement is very demanding physically and can be unsafe, due to the potential for injury. Manual guidance of the rock drill can be very strenuous and uncomfortable after even a short period of use. In addition, the precision with which a hole can be drilled is limited when using a manually guided device. When engaged in repair or survey work, accurate placement of drill holes may be difficult due to fatigue of the drill operator and/or due to unusual positions and angles the drill needs to be manually positioned in.

To make the use of rock drills more convenient, safe, and comfortable, firms have constructed various chasses or frames on which the rock drill, controls, and components of a pneumatic, electric, or hydraulic system are mounted. The chasses are meant to help guide and position the rock drills over the drilling target and to make transportation of the rock drills more convenient.

The current methods employed to carry out these objectives have numerous disadvantages. However, many of the current systems in use, when all rock drill components are fully assembled onto the chassis, are quite large and heavy, weighing upwards of 300 or more pounds. After transporting these chasses to a worksite, mechanical assistance is normally required to safely load and unload a chassis from the transporting vehicle. The use of these prior art systems thus requires a forklift, backhoe, or other similar heavy machinery to set up. In many situations, several worksites must be visited in one day, making the loading and transportation of the chasses inconvenient and time consuming. Also, more workers are required in cases in which heavy machinery is unavailable for loading and unloading.

Another objective of the current disclosure is to provide a safer method and system for using rock drills. Rock drills main rotating component configured to rotate when the appropriate power is supplied to them, turning the drill bit to prepare for drilling. The rock drills are attached to a feed mechanism that, when activated, will move the rock drill towards the drilling target and provide the necessary force to push the rotating drill bit into the material being drilled. Current systems can create dangerous situations during drilling when, for example, the drill bit becomes stuck or the operator becomes incapacitated, whether due to personal injury, unstable drilling surfaces, or machine malfunction.

SUMMARY OF THE INVENTION

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment, a rock drill system includes a vertical frame member having a drill side and an operator side, a drill guide sleeve adapted to move axially along a longitudinal axis of a drill guide shaft that is attached in a parallel orientation to the drill side of the vertical frame member, and a feed cylinder that is coupled to both the drill side of the vertical frame member and the drill guide sleeve, wherein the feed cylinder drives the drill guide sleeve along the longitudinal axis of the drill guide shaft relative to the vertical frame member. The rock drill system also includes a rock drill that is attached to the drill guide sleeve, a wheel support member offset from the vertical frame member. and a wheel and bearing assembly supported on the wheel support member.

In another embodiment, a rock drill system includes a vertical frame member having a drill side and an operator side, a drill guide sleeve adapted to move axially along a longitudinal axis of a drill guide shaft that is attached in a parallel orientation to the drill side of the vertical frame member, and a feed cylinder that is coupled to both the drill side of the vertical frame member and the drill guide sleeve, wherein the feed cylinder drives the drill guide sleeve along the longitudinal axis of the drill guide shaft relative to the vertical frame member. The rock drill system further includes a rock drill that is attached to the drill guide sleeve, and a remote control unit operatively connected to the feed cylinder and the rock drill such that the remote control unit is operable to control the feed cylinder and/or the rock drill, wherein the remote control unit is detachable from the rock drill system and movable between an attached position, where the remote control unit is supported on the rock drill system, and a detached position where the remote control unit is detached from and unsupported by the rock drill system.

In a further embodiment, a rock drill system includes a vertical frame member having a drill side and an operator side, a drill guide sleeve adapted to move axially along a longitudinal axis of a drill guide shaft that is attached in a parallel orientation to the drill side of the vertical frame member, and a feed cylinder that is coupled to both the drill side of the vertical frame member and the drill guide sleeve, wherein the feed cylinder drives the drill guide sleeve along the longitudinal axis of the drill guide shaft relative to the vertical frame member. The rock drill system also includes a rock drill that is attached to the drill guide sleeve, a wheel support member offset from the vertical frame member, a wheel and bearing assembly supported on the wheel support member, and a remote control unit operatively connected to the feed cylinder and the rock drill such that the remote control unit is operable to control the feed cylinder and/or the rock drill, wherein the remote control unit is detachable from the rock drill system and movable between an attached position, where the remote control unit is supported on the rock drill system, and a detached position where the remote control unit is detached from and unsupported by the rock drill system.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

BRIEF DESCRIPTION OF THE DRAWINGS

One or more preferred embodiments that illustrate the best mode(s) are set forth in the drawings and in the following description. The appended claims particularly and distinctly point out and set forth the invention.

The accompanying drawings, which are incorporated in and constitute a part of the specification, illustrate various example methods and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples, one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION OF THE DRAWINGS

Disclosed herein is a compact, ergonomic and safer rock drill chassis that permits convenient transportability and automatic use of a rock drill at worksites. The system is embodied in a portable rock drill system that generally comprises a rock drill and a rock drill chassis, where the chassis may be moved from a transport into drilling position by two or, preferably, one operator, traveling on a supporting wheel system. Once in drilling position, the rock drill system may be readily shifted into an immobile position resting on a horizontal bearing surface, and supported by a tripod of supports. The rock drill system is stable and self-supporting when in the immobile, or operating position, and the drill head and drill can be activated to drill into the bearing surface.

Figure 1A:
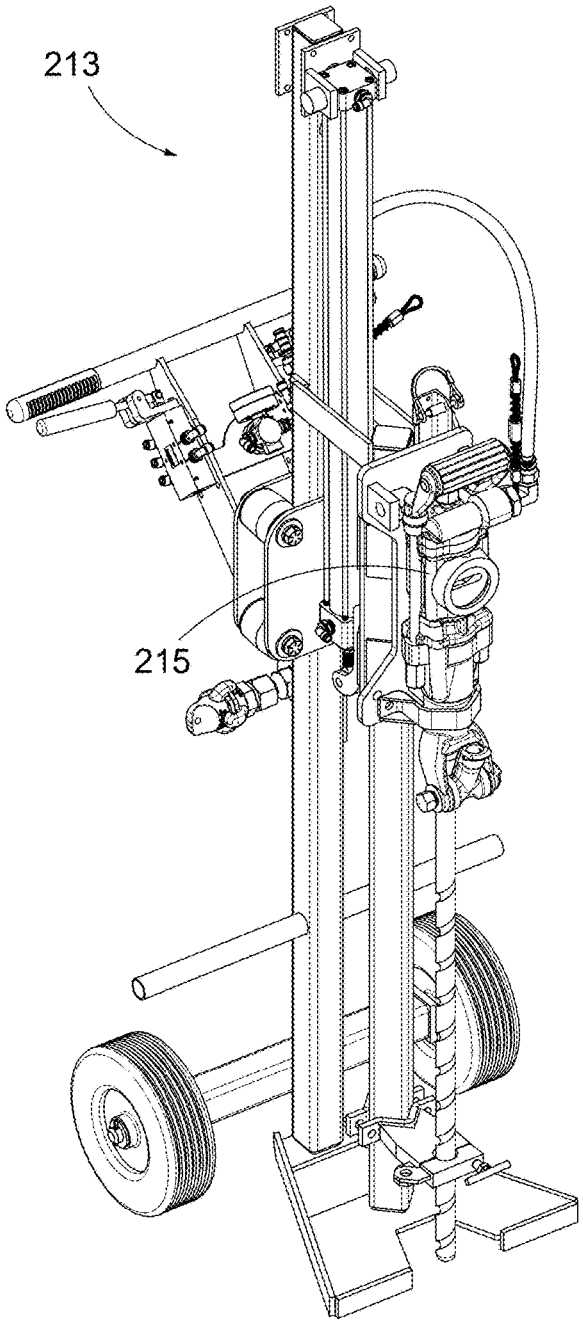
FIG. 1A (PRIOR ART)
FIGS. 1A and 1B illustrate two embodiments of the chassis in different sizes.
Figure 1B:
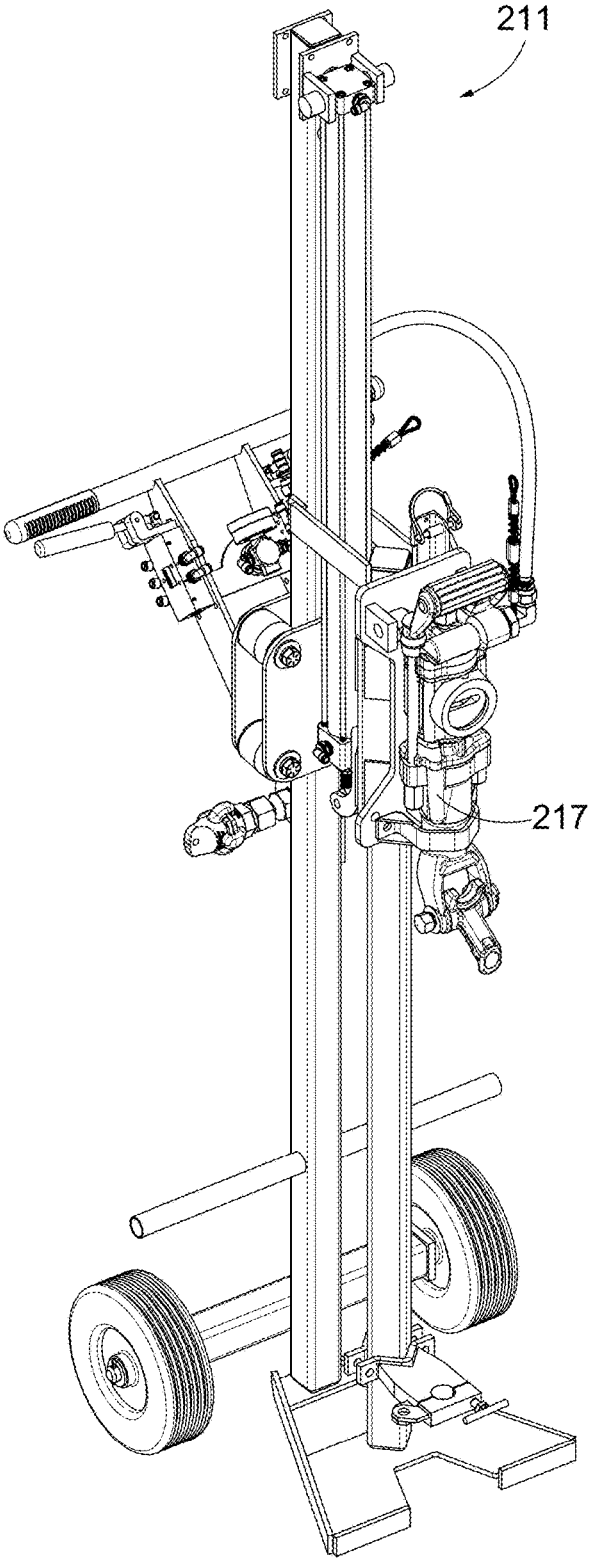
FIG. 1B (PRIOR ART)

Embodiments of the chassis are shown generally in FIG. 1 at 100 and 102. Chassis 102 is configured for optimal use with a standard 30-pound rock drill 104 for use with drill bits up to one and five-eighths inches in diameter. A smaller chassis may be produced using the teachings herein, for example, 15-pound rock drills for use with drill bits up to one-inch in diameter. The 30-pound rock drill can be provided for more versatile uses as it encompasses the drill hole diameter capability of the 15-pound rock drill, with the disadvantage being the larger chassis size needed to support the larger drill. Likewise, chassis 100 is shown to be configured for optimal use with a standard 50-pound rock drill 106 for use with even larger drill bits.

As disclosed, the rock drill system is adapted for drilling into earth, soil, and, preferably, paved surfaces. Utility service workers commonly require the drilling of holes into paved surfaces for the purposes of installing connections, or for inspection purposes. In particular, natural gas service workers or workers in other commodity pipeline fields may require the drilling of holes in the surfaces surrounding buried supply or transmission pipelines for the purpose of detecting or "sniffing" for leaks. Likewise, water utility workers may wish to drill holes in order to isolate a leak in a water main or supply connection. In many cases, the pipelines are buried beneath roadways or residential streets. The present embodiments provide for the delivery of the portable rock drill system by means of a vehicle, such as in the bed of a utility service truck or utility trailer. The embodiments disclosed herein allow service workers (i.e., operators) to move the rock drill system from the transport vehicle to the work location without the use of a crane or other heavy equipment, or without the risk of physical injury due to excessive bulk or unwieldy nature of previously existing systems.

Figure 2:
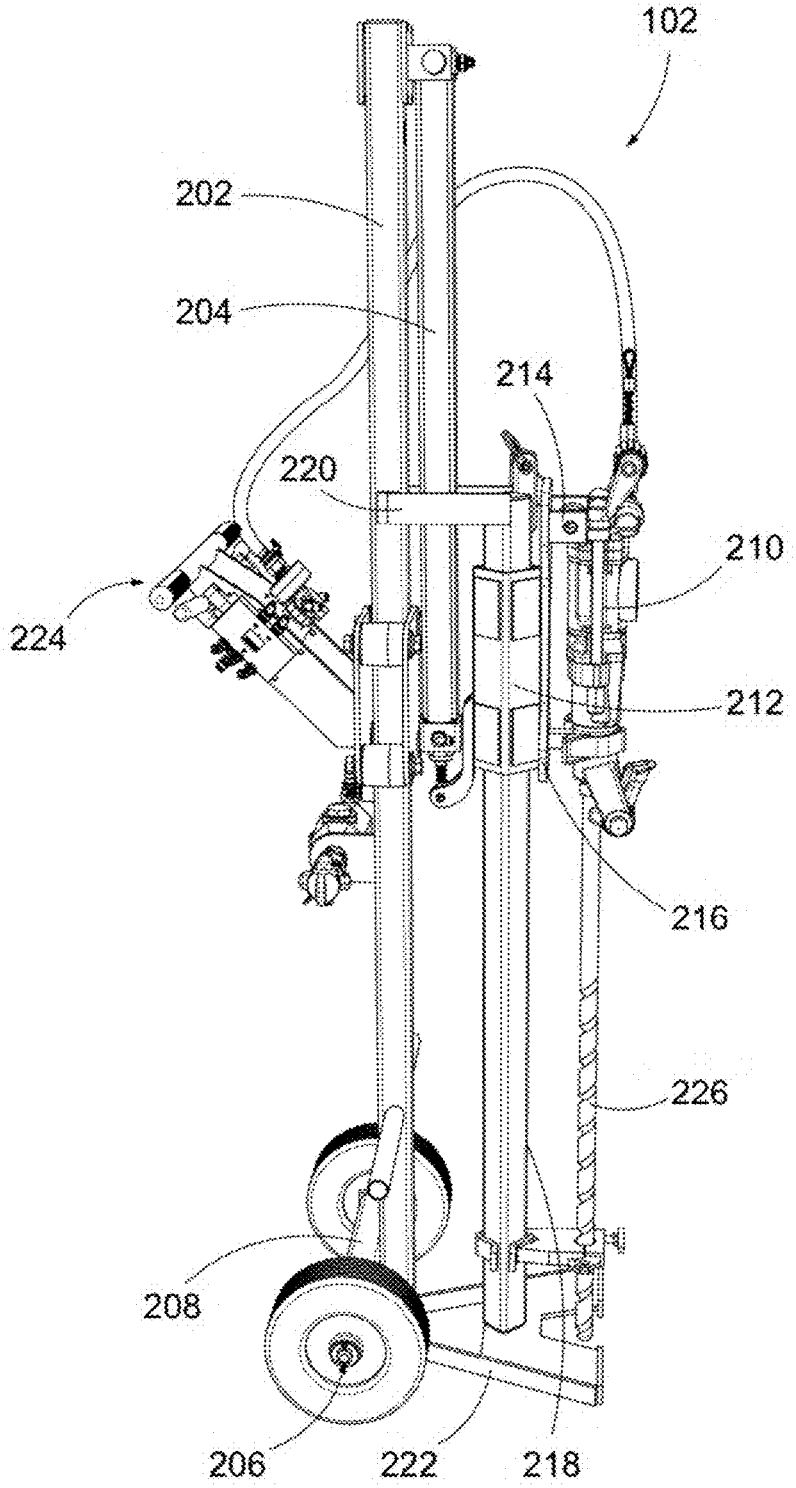
FIG. 2 (PRIOR ART)
FIG. 2 shows a right side view of a preferred embodiment of the chassis.

Turning the FIG. 2, a side profile of the 30-pound rock drill chassis embodiment 102 is shown. The principles of the current invention will be described in connection with the features of this embodiment, but may be readily applied to other chassis sizes as will be apparent to those skilled in the art.

The chassis 102 is provided with a vertical frame member 202. The vertical frame member 202 has an anterior side (i.e., a drill side) and a posterior side (i.e., an operator side). Vertical frame member 202 may be fashioned out of any rigid material suitable for use as a load-bearing member in a structural assembly. A preferred embodiment utilizes hollow steel or aluminum tubing of square cross section, but other materials, solid or hollow, may be utilized such as Titanium or other alloys. The vertical frame member 202 extends from the weight bearing surface beneath the chassis 102 when in an up-right resting position, and upwards from that surface to a height that will accommodate the feed mechanism's, or feed cylinder's 204 required range of movement. In particular, the length of the vertical frame member 202 is the combination of the maximum length of the rock drill combined with the length of the drill bit. To accommodate longer throws, i.e. deeper/longer holes, once the initial maximum length is used, a drill bit extension (not shown) can be mounted on the end of the embedded drill bit in order to drill a longer (deeper) hole.

The use of a vertical frame member 202 as the primary structural component of the chassis accomplishes the objectives of the current endeavor in several manners. First, prior art systems often employ a more generally box-shaped chassis frame system, which results in the need for more structural material to support the rock drill and its components. These systems are very heavy and require multiple workers to load, unload and transport, often requiring use of heavy machinery. The use of a single vertical frame member greatly reduces the amount of structural components and material, thereby resulting in a significant reduction in the overall weight of the chassis. This reduction in weight allows a single operator to move the chassis about a worksite, and to load and unload the chassis from the transporting vehicle with ease and safety.

Figure 3:
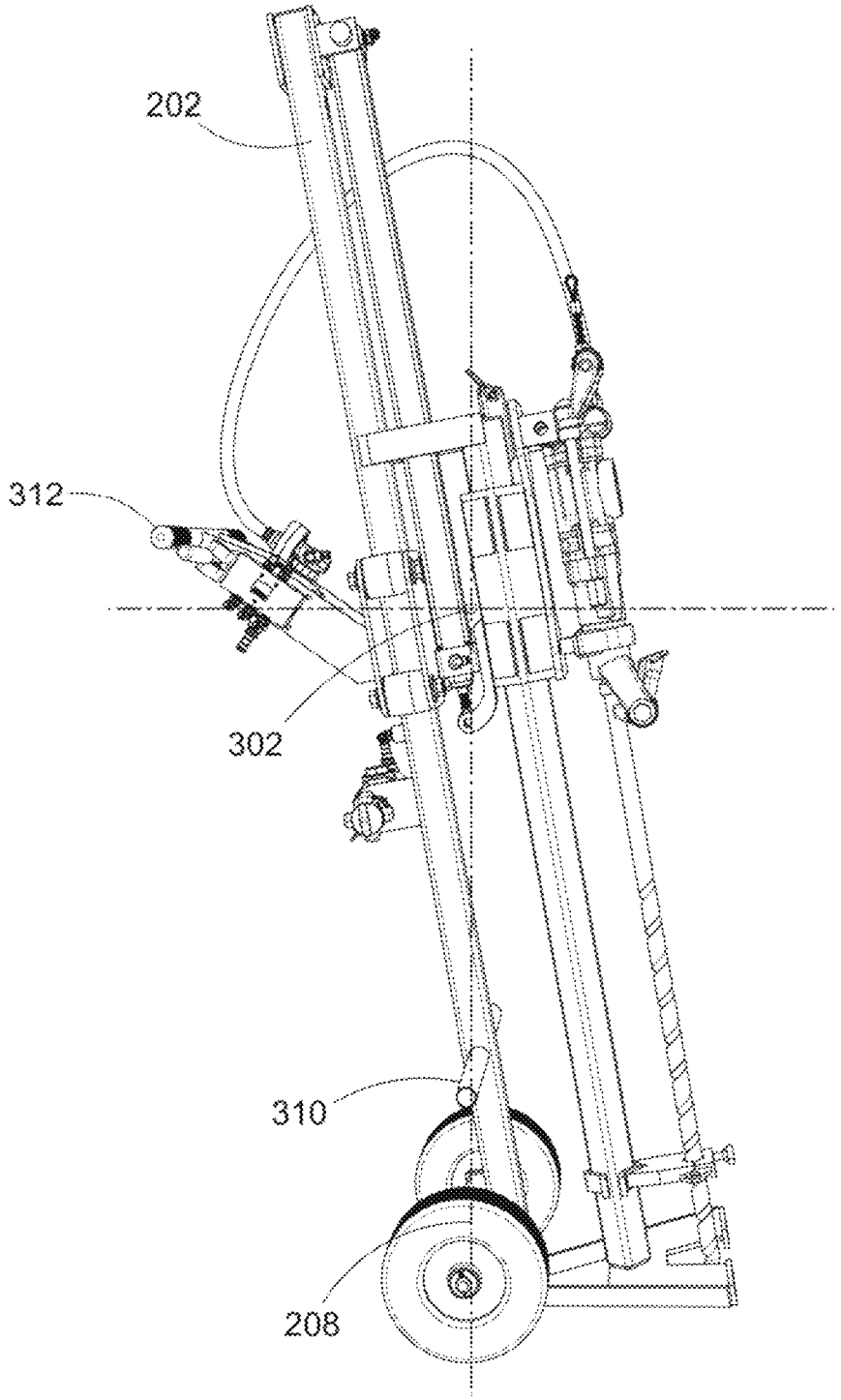
FIG. 3 (PRIOR ART)
FIG. 3 shows an additional right side view of the embodiment shown in FIG. 2.

A second advantage of the use of vertical frame member 202 and its configuration relative to other chassis components is its centerline's proximity to the axis of rotation created by the wheel and bearing assembly 206 affixed to a wheel support member 208. As shown in FIG. 3, the chassis center of gravity is approximately located at point 302. Locating the center of gravity 302 (FIG. 3) close to the vertical frame member 202 permits the convenient placement of lower lift points or manual grips 310 directly on, and extending laterally away from, the vertical frame member 202. Operators use the operation handle grips 312 during drill use. The convenience of locating lower lift points on the vertical frame member 202 allows a user positioned on a lateral side of the chassis to hold an operation handle grip 312 (or upper lift point) in one hand and a lower lift point in the other hand, with both lift points being centered about the chassis center of gravity 302. Such a configuration thereby creates a balanced load from the user's perspective. This in turn allows a two-person team, with each member on a lateral chassis side, to comfortably and conveniently lift the lightweight chassis as needed, for example loading and unloading. Once the system is off-loaded from the transport vehicle, an operator may move it using the provided wheels.

Variations in the placement and configuration of the wheel support member 208, as well as optional features (e.g., dust collection systems), on the chassis can shift the location of the center of gravity 302, which may be advantageous for different size chasses. For example, the wheel support member 208 and, by its nature the wheel and bearing assembly axis of rotation, may be attached to the vertical frame member 202 on the posterior side, as shown in FIGS. 2 and 3, or may alternatively be attached to the anterior side (not shown) or extend laterally from the lateral sides of the vertical frame member 202.

Note that the vertical frame member 202 need not necessarily be comprised of a single structural member, but may be a combination of, for example two or more, smaller structural members secured side by side. The importance of the vertical frame member is its lightweight characteristic, and its position relative to the center of gravity, the latter of which allows for convenient and multiple lateral lift points to be employed as previously described.

Returning to FIG. 2, the rock drill 210 is shown mounted on hollow drill guide sleeve 212. Such mounting may occur via securing rock drill lugs to a plurality of rock drill attachment mounts, for example, attachment mounts 214 and 216. The hollow drill guide sleeve 212 slides along the drill guide shaft 218, which is secured to the vertical frame member 202. In the preferred embodiment, the drill guide shaft 218 is secured to the vertical frame member 202 at its distal (upper) end via a drill guide shaft attachment plate 220 and at its proximal (lower) end via a foot member 222. The foot member 222 rests on the bearing surface, and, together with the wheel and bearing assembly 206, support chassis 102 when it is in an upright position. The figures depict embodiments where wheel and bearing assembly 206 includes two wheels, which together with foot member 222, form a generally three-point support structure when the chassis 102 is in the upright position. While foot member 222 may have varying dimensions, it will be understood by one skilled in the art that a larger foot member 222 provides more stability during operation and, moreover, certain applications may have constraints that limit the maximum size of foot member 222. The drill guide shaft 218 may be secured in other various ways as appreciated by those skilled in the art; the figures merely depict embodiments that permit the largest range of movement with respect to the drill feed path.

Generally, a control tree or control stem 224 is provided having operation handle grips as shown in FIG. 3 at 312, for example. The control tree or control stem 224 can house the feed and drill valves and valve actuators, as well as other components of the power system, as described in further detail below. The depicted embodiments depict control tree 224 extending from the operator side (i.e., the posterior side) of the vertical frame member 202. However, significant vibration may occur during operation, which is transmitted throughout the entire chassis (e.g. chassis 100 and/or 102), including vibration transmission into the vertical frame member 202, the control tree 224, and any handle grips 312 connected thereto. Therefore, an anti-vibration assembly may be utilized to dampen and/or control the resonance in the system. As detailed below, an exemplary anti-vibration assembly may interconnect the control tree 224 and the vertical frame member 202, thereby reducing, if not eliminating, the vibration and/or resonance experienced by a rock drill operator.

In the illustrated embodiment, the feed cylinder 204 is attached to the top side of vertical frame member 202, and provides the power for the linear movement of the rock drill 210 and rock drill rod 226 along the drill rod's axis of rotation. Its plunger, positioned at its proximal end, is connected to the drill guide sleeve 212, transmitting feed cylinder 204 movement to the rock drill guide sleeve 212, rock drill 210, and drill rod 226. In a preferred embodiment, a simple clevis configuration is used to connect the rock drill guide sleeve 212 to the feed cylinder 204 plunger, although any comparable mechanical connection or method of affixing may be used.

Figure 4:
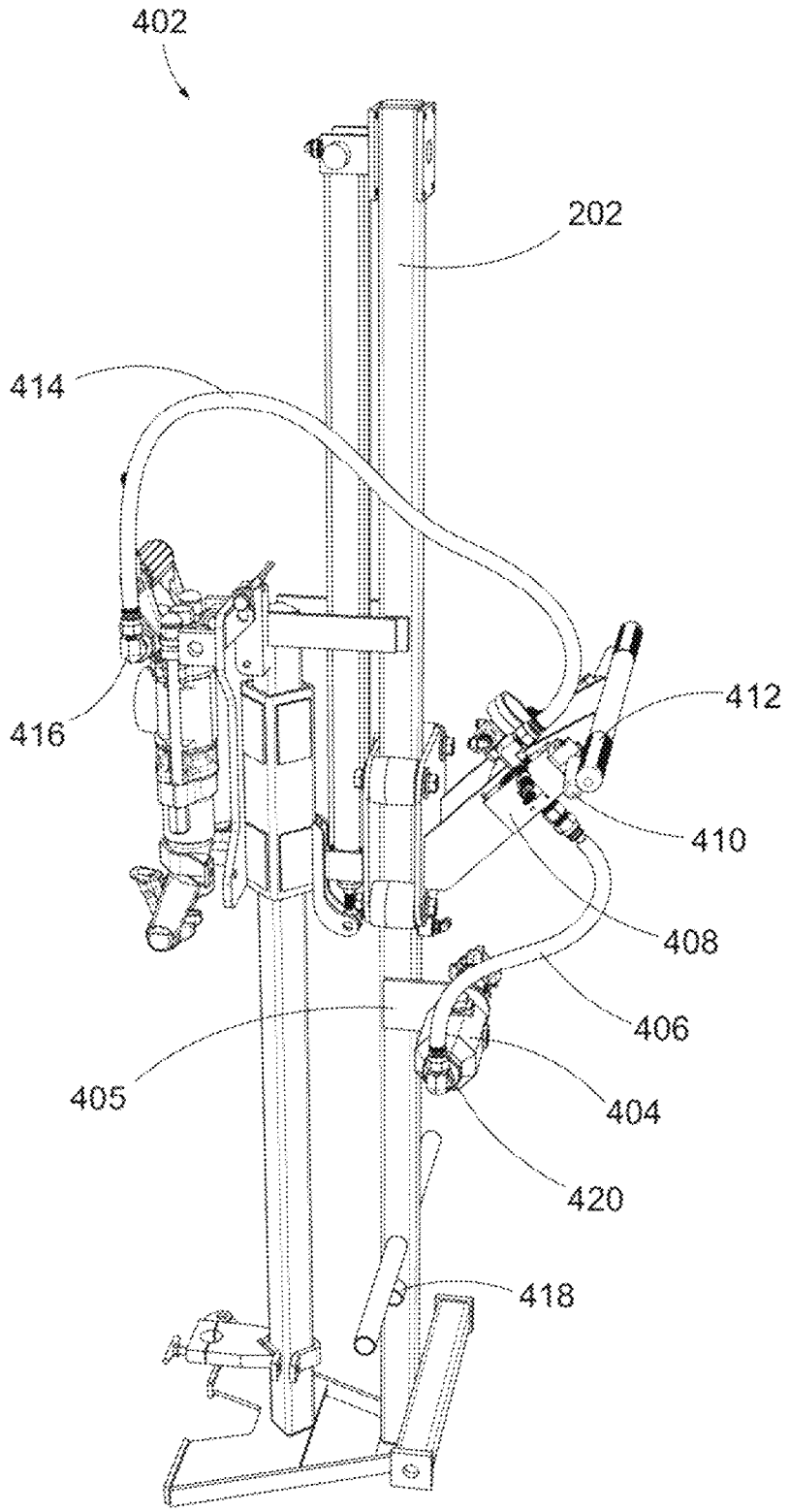
FIG. 4 (PRIOR ART)
FIG. 4 shows a left side view of a chassis without a wheel assembly.

Turning to FIG. 4, a view from the left (sinistral) side of a chassis 402 is shown. A lubricator component 404 is shown secured to the vertical frame member 202 power connection mounting plate 405. Hose 406 leads away from the lubricator 404 to feed the input on the drill valve assembly 408. The drill valve assembly is actuated between open and closed positions via spring-centered actuator handle 410 located on the anterior side of the sinistral operator handle grip 412. The spring-centered position of the handle 410 corresponds to the closed valve position, its default position. When squeezed against the grip 412, the valve opens and pressurizes hose 414, which leads to the power input on the rock drill 416, thereby causing the drill rod (not shown) to rotate for drilling. In some embodiments, one or both ends of pressurized hoses 406 and 414 are fitted with a hose restraint, for example, a cable hose restraint. Where only one end of hoses 406 and 414 is fitted with assembly hose restraint, such hose restraint should be fitted on the ends of hoses 406 and 414 that are nearest to the operator. The hose restraint will tether the ends of hoses 406 and 414 to a portion of chassis 402 near their point(s) of interconnect, so as to prevent hoses 406 and 414 from being unintentionally disconnected during use and potentially harming the operator. For example, hose restraints may be attached to the operator sides of both hoses 406 and 414 to interconnect those sides of those hoses to the control tree 224, so as to not injure the operator if they disconnect or "blow off" during operation. In other embodiments, hose restraints are attached to the operator side of hoses 406 and 411 as described, but also attached to the other non-operator sides of hoses 406 and 414 so as to secure that end of the hoses 406, 414 to the chassis 402. In even other embodiments, hose restraints may be attached to the operator sides of some hoses, the other sides of other hoses, and both sides of even other hoses. The various other hoses, tubes, cables, etc. of the rock drill apparatus may be similarly secured via hose restraints as described herein.

Figure 20A:
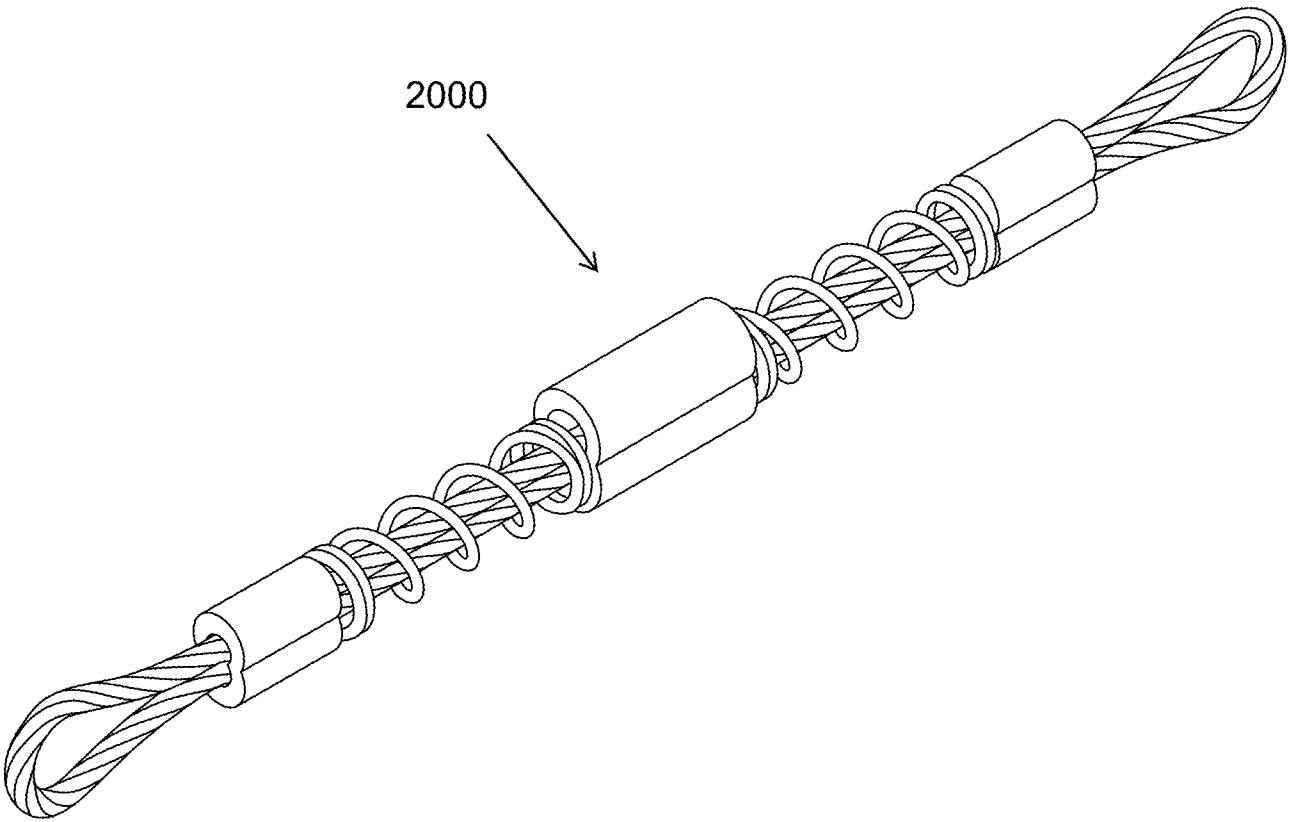
FIG. 20A (PRIOR ART)
FIGS. 20A & 20B depict various views of the rock drill system's hose restraints.
Figure 20B:
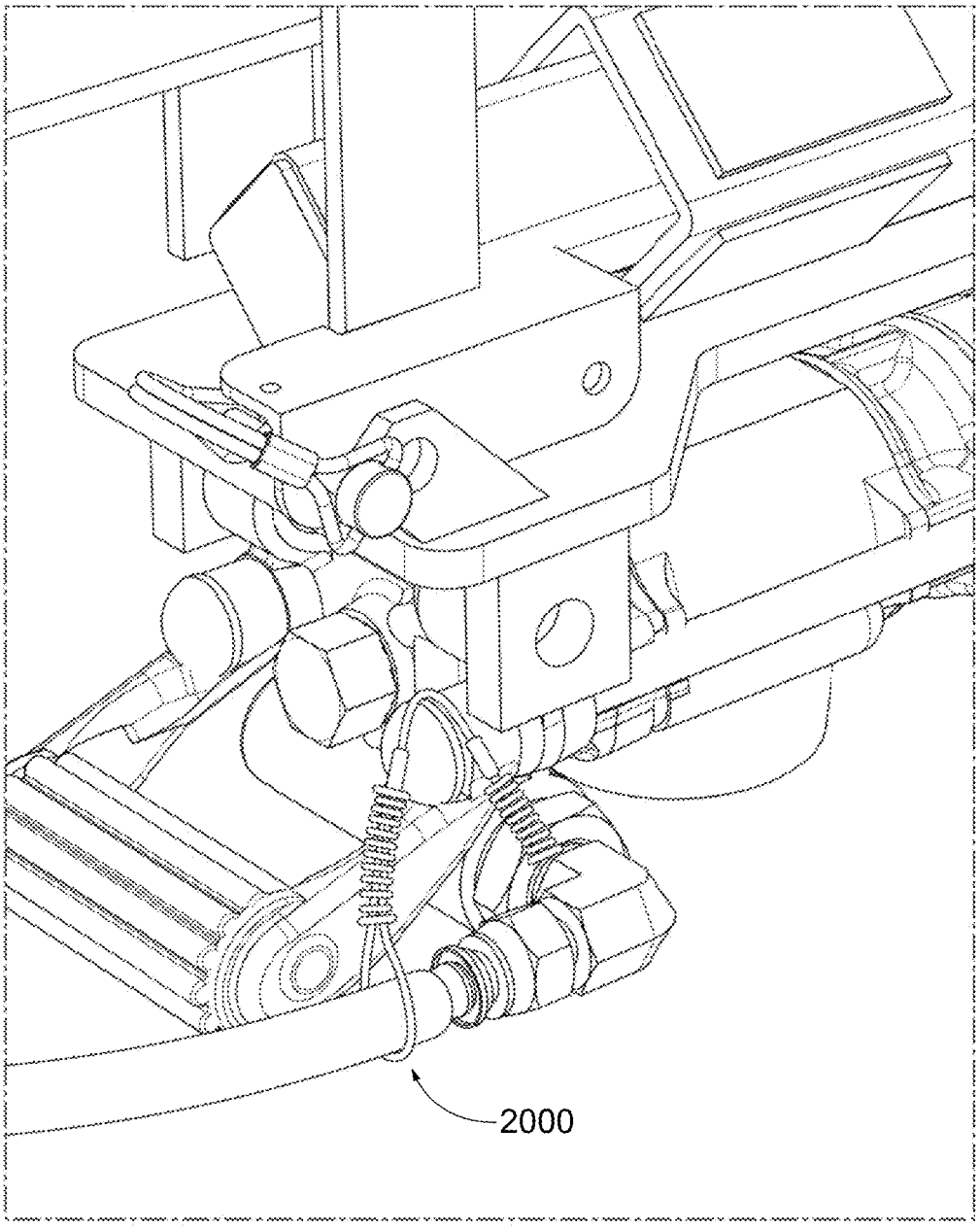
FIG. 20B (PRIOR ART)

FIG. 20A depicts a hose restraint. More specifically, FIG. 20A depicts an exemplary cable hose restraint 2000, which is sometimes referred to herein as "whip check assembly." Cable hose restraints 2000 may be utilized as discussed above and may be incorporated into the rock drill apparatus as illustrated in FIG. 20B, as well as FIGS. 13, 14A, and 14B; however, one skilled in the art will appreciate that different restraints may be utilized, for example, to prevent pressurized hoses from contacting the operator if they become disconnected during operation. It will also be appreciated that the hose restraints detailed herein may be similarly utilized on other pressurized hoses of the rock drill apparatus to further enhance operator safety. Cable hose restraint 2000 may be of varying types of known hose restraint apparatuses. In the illustrated embodiments, cable hose restraint 2000 comprises a length of cable with opposing ends, where the opposing ends are configured into closed loops for attachment to a hose. The closed loops may be spring loaded, or include other dampening elements, but such spring or dampening elements should be selected based on the specific hose pressure encountered. In one embodiment, cable hose restraint 2000 comprises steel cables and plated springs, with Aluminum ferrules. However, cable hose restraint 2000 may be provided in a variety of designs, including stainless steel and copper ferrules. In the illustrated embodiment, cable hose restraint 2000 is provided separate from, and not integral with, the apparatus. In other embodiments, however, the hose restraints may be integral with and/or attached to the apparatus. For example, the hose restraint may be a protrusion or arm extending from the apparatus and configured to secure an end of the hose at a certain location relative to the rock drill apparatus. In other examples, a cable hose restraint may fixed (for example, by welding) to the apparatus at one end and, at the other end, configured as discussed with regard to cable hose restraint 2000 so as to secure the hose end.

In a typical implementation the rock drill apparatus is supplied with motive force through compressed air delivered from an associated air compressor (not shown). It is known to those skilled in the art that other motive forces can be implemented. For example, the rock drill apparatus may be powered by one or more of pneumatic, electric, or hydraulic motive forces. In a further embodiment, the drill feed actuator could be driven by hydraulic means, while the drill bit rotation driven by pneumatic systems.

The spring-centered valve actuator 410 increases the safety of the apparatus when in use in the field. Releasing the valve actuator 410, whether purposely or by accident, will cease the rotation of the drill, as constant pressure is required to maintain the open valve position. In cases of accident, such as operator incapacitation or machine malfunction, swift and automatic "dead man" switches will greatly decrease the potential for serious injury to the operator, bystanders, and the drilling target.

Figure 5:
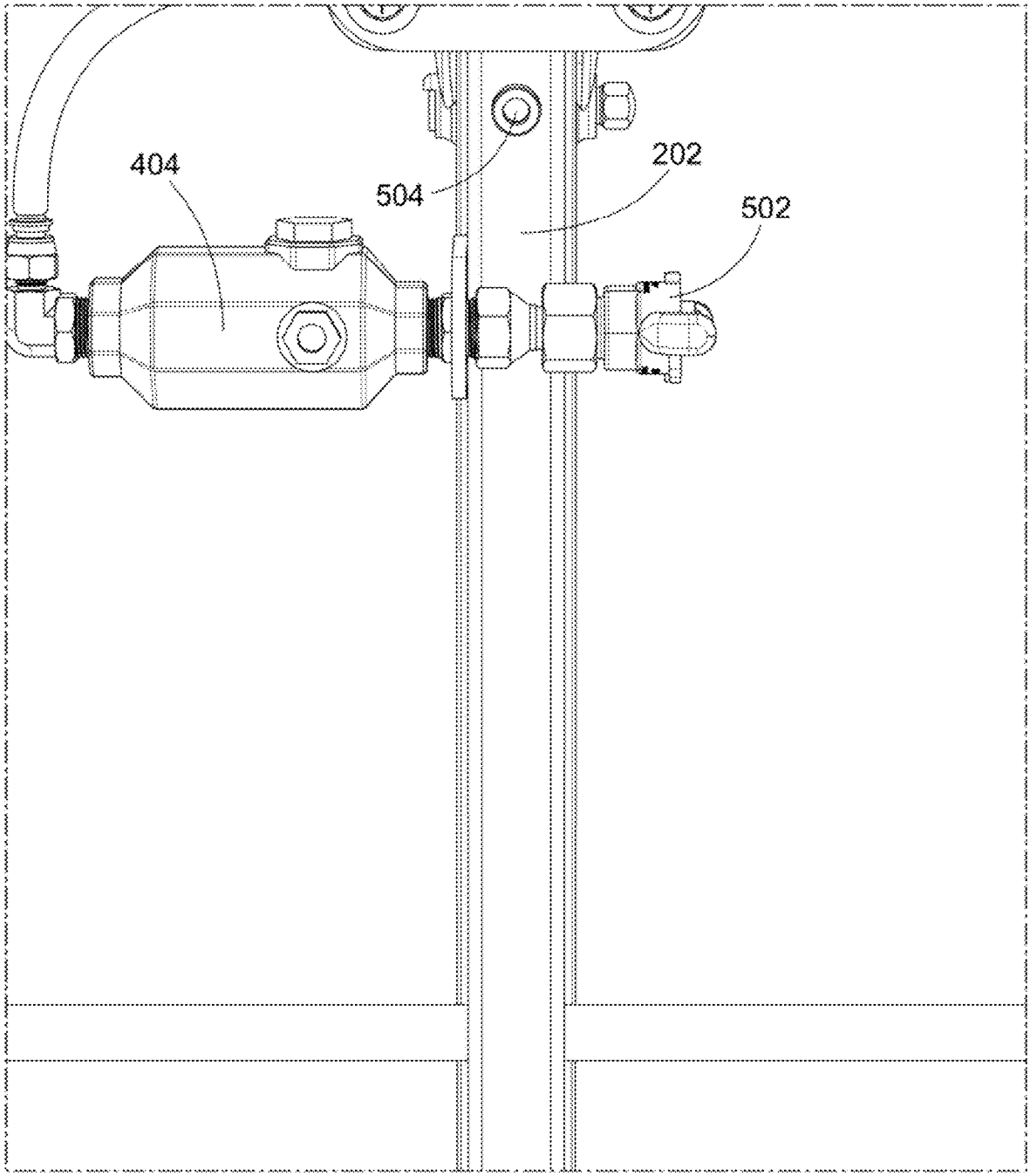
FIG. 5 (PRIOR ART)
FIG. 5 shows a back view close up of a portion of the vertical frame member and components attached thereon.

Secondary exhaust hole 418 provides an exhaust for excess air pressure that is vented into the interior of the vertical frame member 202. The location of the exhaust hole 418 should be such that pressurized exhaust is directed safely away from the operator. Turning to FIG. 5, the primary exhaust hole 504 is shown on the vertical frame member 202. This primary exhaust hole 504 is configured with an elbow or outlet hose fitting to receive an exhaust deflector (not shown) to deflect the primary exhaust in a safe direction. In one embodiment, the primary exhaust hole 504 and/or secondary exhaust hole 418 are threaded or tapped so as to receive a threaded push lock fitting (not shown) or similar component, which will ensure a secure connection to any hose/fitting connected thereto. FIG. 5 also depicts a posterior view of the lubricator 404, and shows the power inlet—in this case a pneumatic input hose fitting—at 502.

Figure 6:
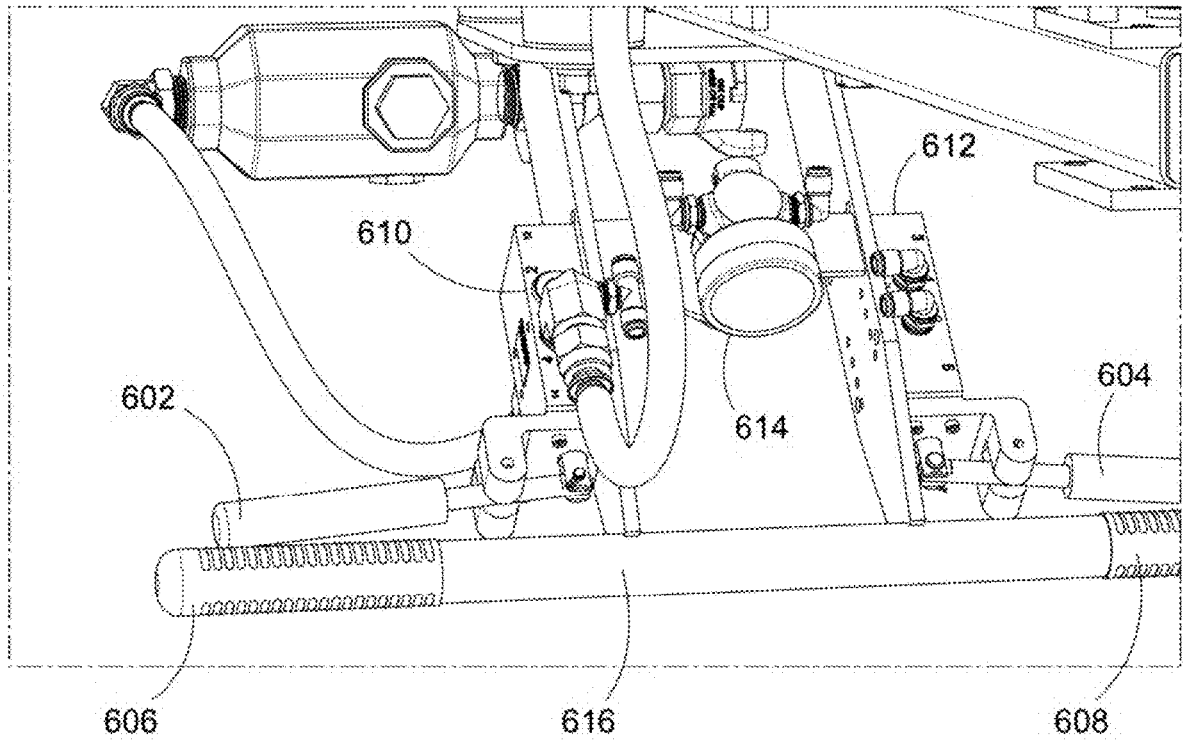
FIG. 6 (PRIOR ART)
FIG. 6 shows a top view of the chassis control tree.
Figure 7:
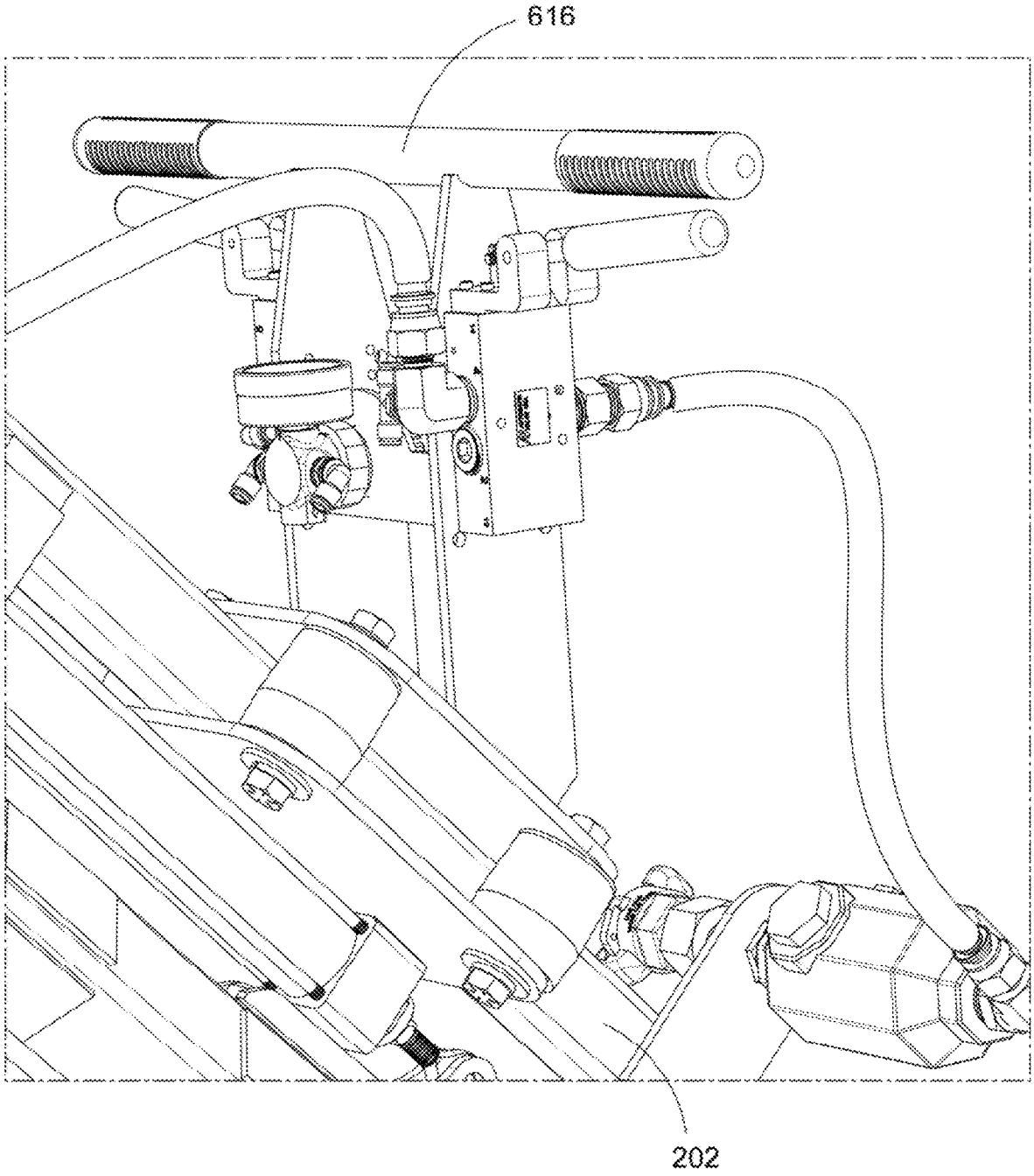
FIG. 7 (PRIOR ART)
FIG. 7 shows a perspective left side view of the chassis control tree.

FIG. 6 depicts the chassis drill controls from the operator's vantage. The drill valve actuator 602 and feed valve actuator 604 are shown, each positioned on the anterior side of the sinistral (i.e., left) operator grip 606 and dextral (i.e., right) operator grip 608, respectively. The operator holds the left and right operator grips 606 and 608 both during drill use and when tilting the chassis back off of the foot member for positioning. The drill valve 610 and feed valve 612 are shown attached to the pillars of a y-type control arm 616, which is in turn attached to the vertical frame member at a height appropriate for use while standing. In this embodiment y-type control arm 616 comprises two pillars (or shafts, supports, structures, etc.), however, one skilled in the art will appreciate that a y-type control arm 616 may have any number of pillars. Moreover, a y-type control arm 616 is not required and different control arm configurations may be utilized. Pressure regulator 614 is shown attached to the back of the control arm 616. FIG. 7 shows an additional view of the attachment of the control arm 616 to the vertical frame member 202.

Figure 8:
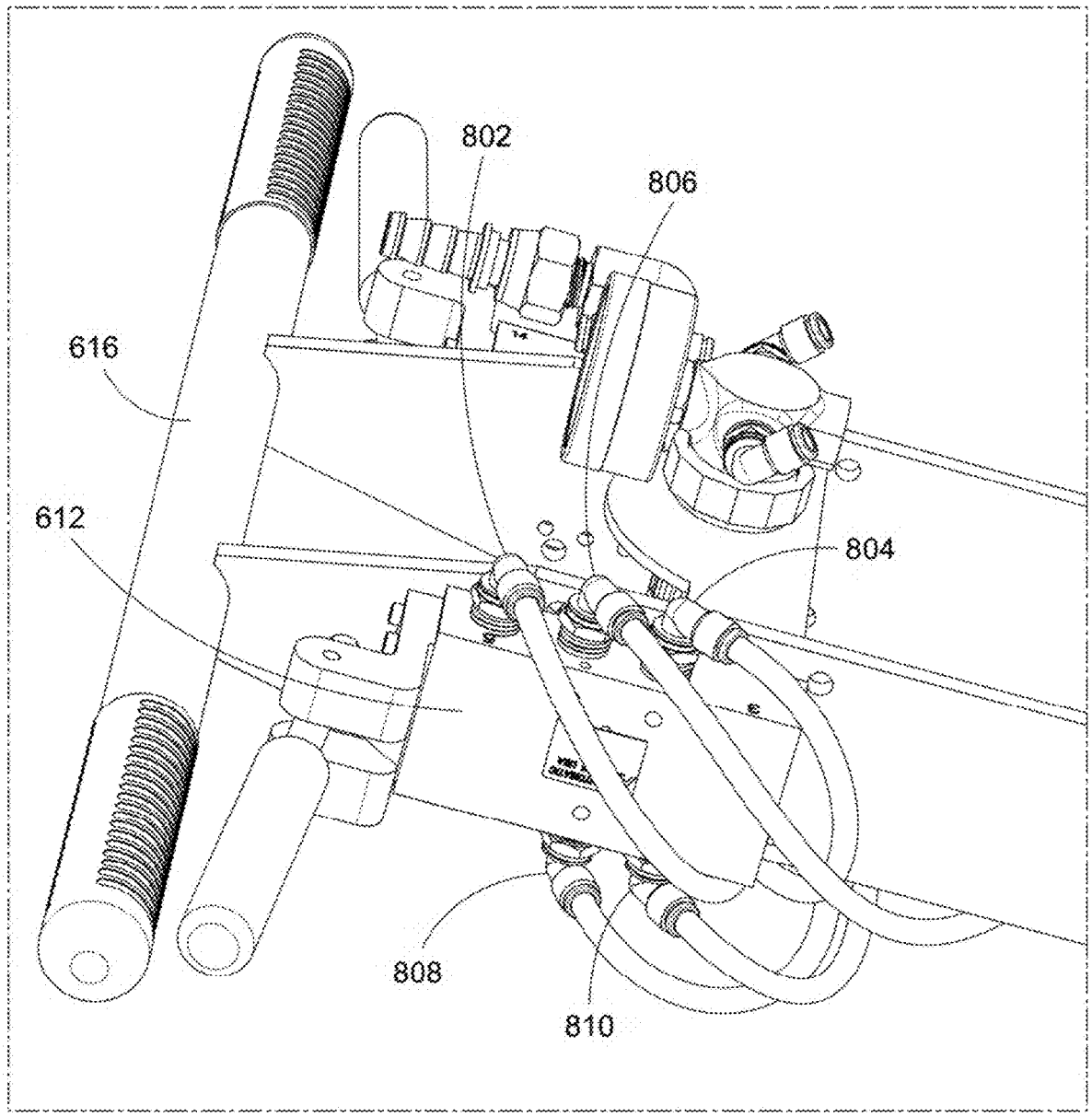
FIG. 8 (PRIOR ART)
FIG. 8 shows a right side view of the chassis control tree.
Figure 9:
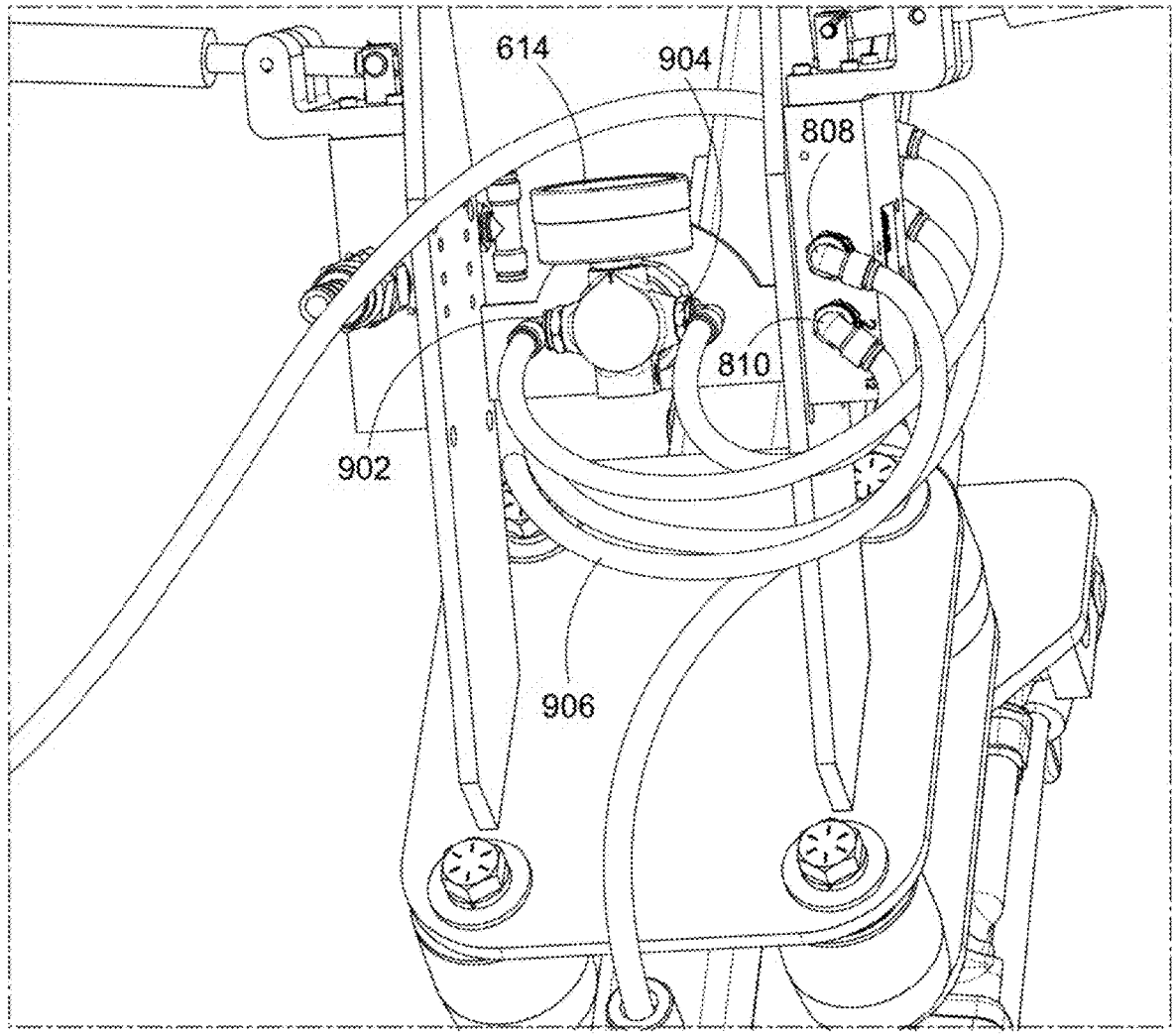
FIG. 9 (PRIOR ART)
FIG. 9 shows a bottom view of the chassis control tree.
Figure 10:
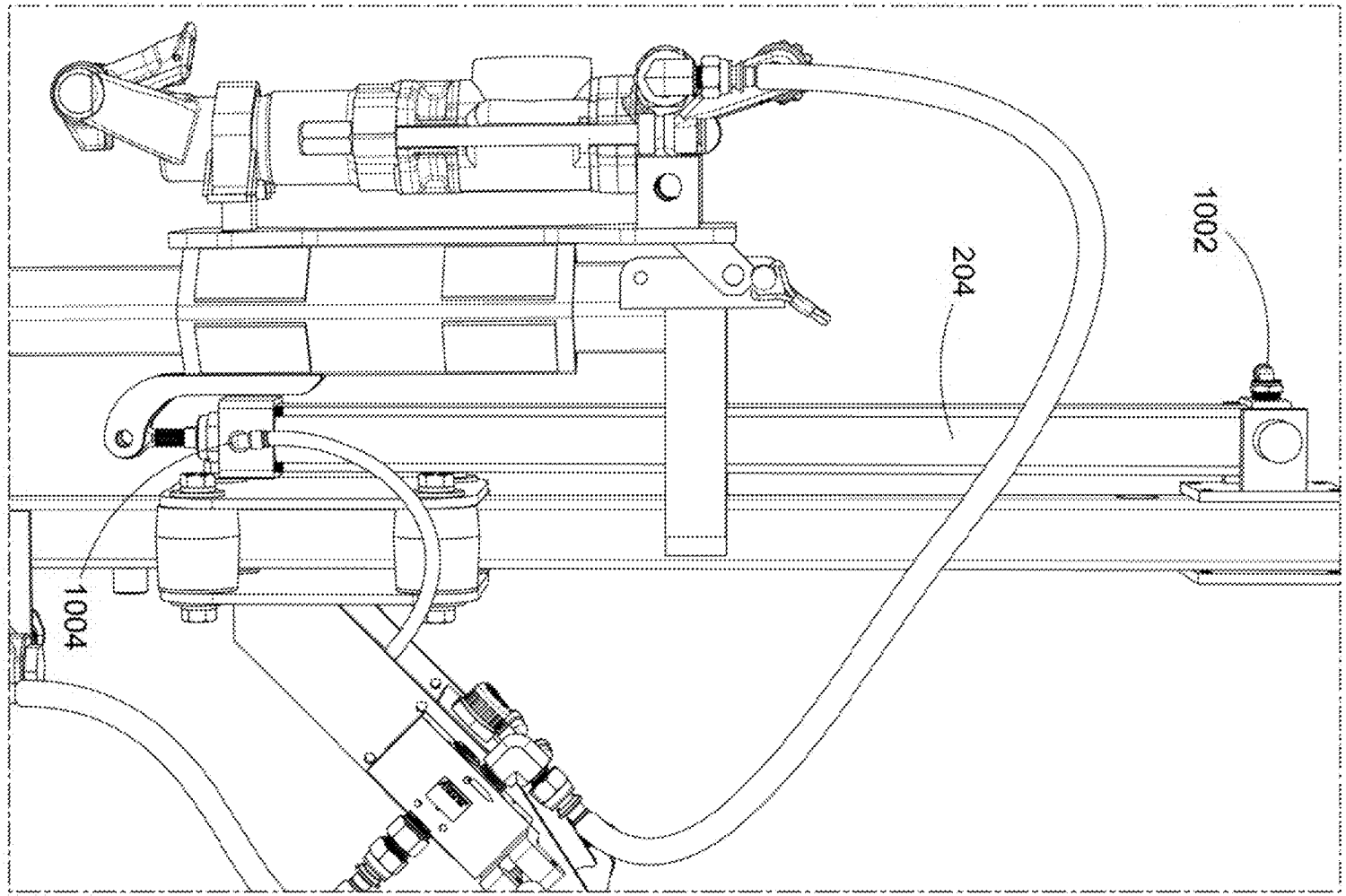
FIG. 10 (PRIOR ART)
FIG. 10 shows a partial left side view of a chassis embodiment with air hoses installed on the air fittings.

FIG. 8 provides a dextral view of the control arm 616 on a chassis embodiment that has had air connection hoses installed on the feed valve 612. The topmost left air fitting 802 is a T-valve fitting that both receives air from the lubricator 404 (FIG. 4) via its feed valve output fitting 420 (FIG. 4) and is connected to the pressure regulator 614 input 902 (FIG. 9). The pressure regulator 614 output 904 is in turn connected to the topmost right air fitting, which is the regulated air fitting input 804 in FIG. 8. Exhaust air fitting 806 vents to the interior of the vertical frame assembly. The extend drive fitting 808 and retract drive fitting 810 are connected to the feed cylinder's extend fitting 1002 and retract fitting 1004, respectively, as shown in FIG. 10. FIG. 9 depicts an embodiment where the feed hoses are bundled in wrapping 906, which keeps loose air hoses from becoming entangled. To enhance operator safety, hose restraints (e.g., whip check assemblies) may be fitted on the ends of the foregoing hoses in a similar manner as detailed above.

Again, as described in connection with FIG. 4, the feed valve 612 shown in FIG. 8 is in the spring-centered position, which opens the retract fitting 810 and closes the extend fitting 808. This valve position operates as a "dead man" switch, as described in connection with the drill valve. Therefore, if an operator were to suddenly lose grip, fall, experience health problems, or the like, thereby releasing the grips, feed valve would automatically disengage from an "open position" where feed valve actuator 604 was engaged/pulsed towards grip 608 to a "closed position" where the drill would cease to rotate and the rock drill would retract from the drilling surface. This feature is not present in the prior art versions of similar single-operator chasses and is shown to be a valuable safety characteristic in dangerous work environments. Note that feed valve 612 may also be configured with a third and final valve position that transmits higher pressure to the feed cylinder when needed.

Yet another aspect of the current disclosure increases the safety and convenience of the chassis by providing a means to quickly and easily separate the chassis and drill from the drill rod. This feature is useful in the event that the drill rod becomes lodged or stuck in the target material/surface. Drill rods often become stuck in hard material and in material with high particulate concentrations. Dislodging the drill rod is much easier where the chassis and drill do not encumber the use of other tools used to retrieve the drill rod. To dislodge stuck drill rods from the prior art chassis systems, either (i) the entire chassis must be moved along with the drill rod; (ii) heavy machinery must be used; or (iii) the drill rod must be broken in order to the clear the chassis from the area before retrieving the remaining portion of the drill rod.

Figure 11:
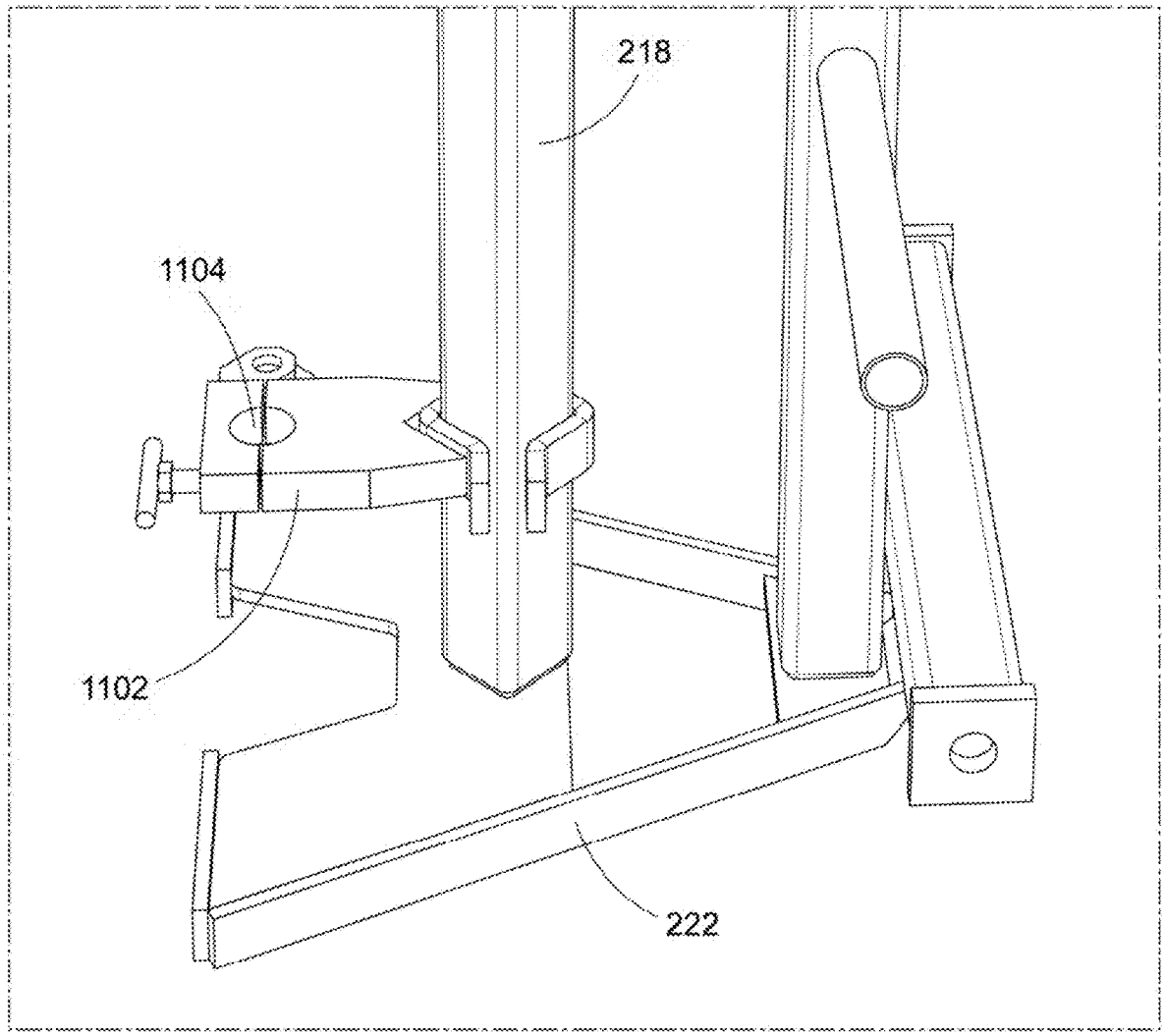
FIG. 11 (PRIOR ART)
FIG. 11 shows a left side close up view of the foot member and drill rod guide.
Figure 12:
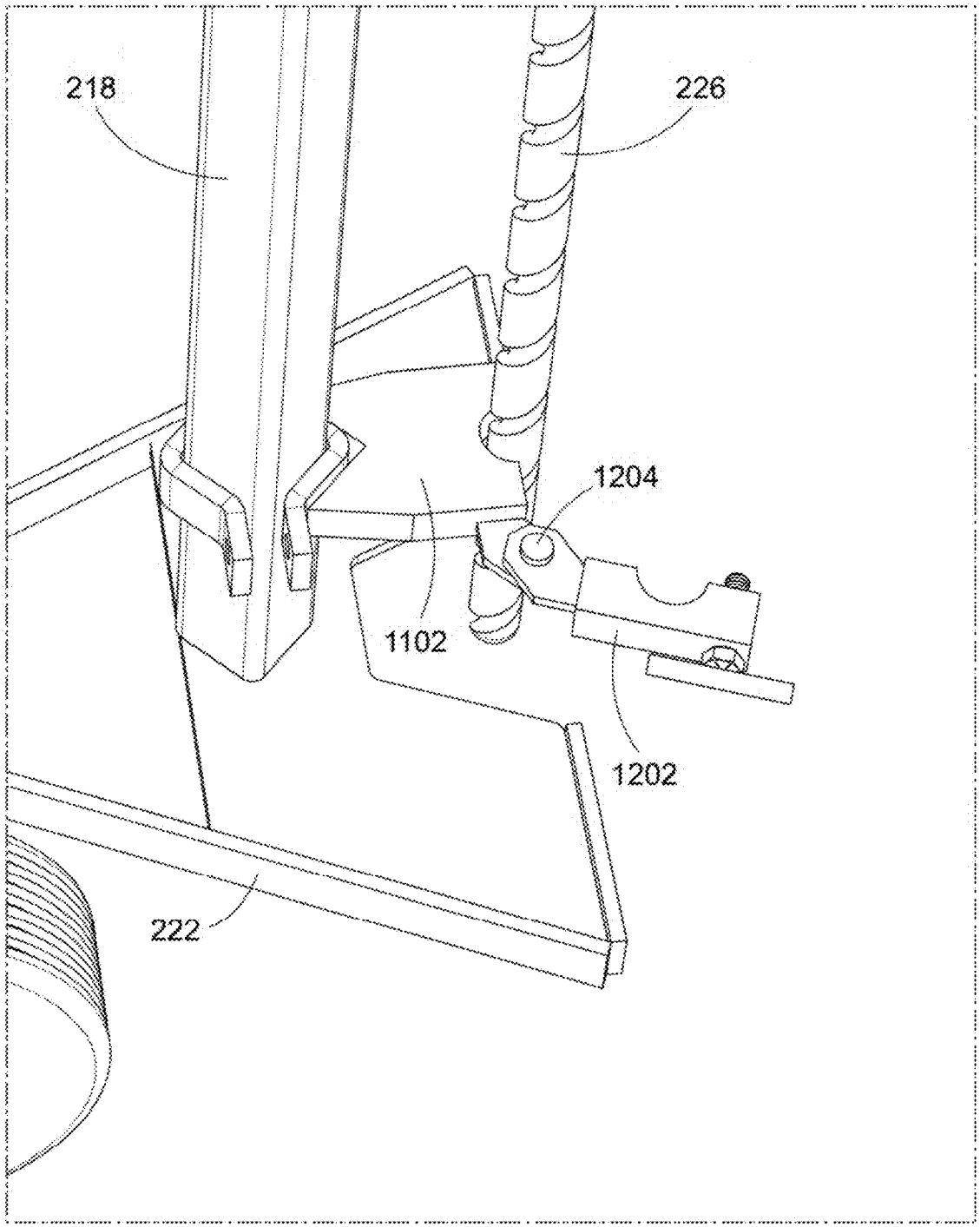
FIG. 12 (PRIOR ART)
FIG. 12 shows a right side view of the drill rod guide when opened for drill rod removal.

The exemplary embodiment depicted in FIGS. 11 and 12 utilizes a drill rod guide 1102 affixed to the foot 222 and/or drill rod guide shaft 218. As in FIG. 11, the drill rod guide 1102 is a generally horizontal plate that extends beyond the circumference of the drill rod 226 (FIG. 12) when the drill is lowered to the target surface. A drill rod guide hole 1104 allows the drill rod 226 to extend through the drill rod guide 1102 during drilling. This improves safety by containing the drill rod in the event it breaks/fractures. A hinged drill rod guide cap 1202 comprises part of the drill rod guide hole's 1104 inner surface, which contains drill rod 226 within drill rod guide 1102 during use and facilitates its removal/replacement when not in use. Hinged on one side at hinge 1204, the hinged drill rod guide cap 1202 may be rotated away from the portion of the drill rod guide 1102 attached to the foot 222 or drill rod guide shaft 218, thereby breaking the circumference of the drill rod guide hole 1104 that constrains lateral movement of the drill rod 226. When a drill rod 226 becomes stuck in the drilling target, hinge 1204 allows the hinged cap 1202 to be opened, so that the drill rod 226 may be released from the drill and the chassis may be either pulled away from the drilling site to allow access to remove the drill rod 226 or change drill rods and continue on to the next drilling target. This feature greatly improves safety and average drilling times over the life of the chassis.

Figure 13:
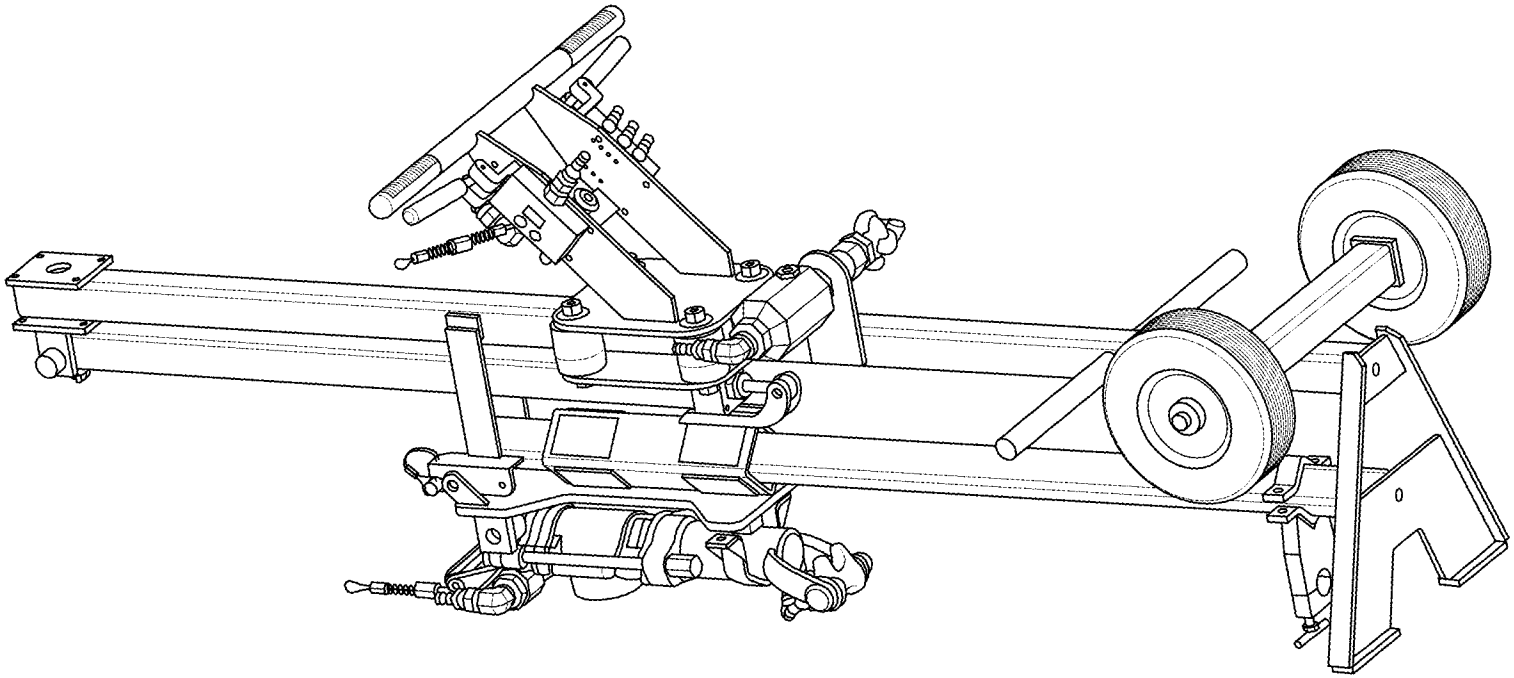
FIG. 13 (PRIOR ART)
FIG. 13 is an isometric view of the another embodiment of the rock drill system having an anti-vibration assembly.
Figure 14A:
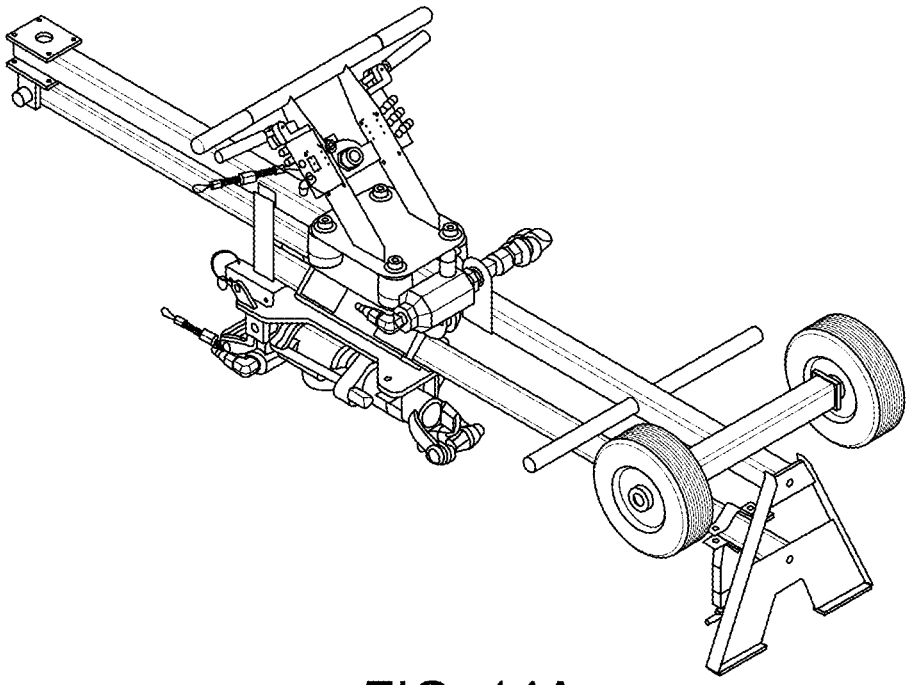
FIG. 14A (PRIOR ART)
FIG. 14*a* is an isometric view of the rock drill system of FIG. 13.
Figure 14B:
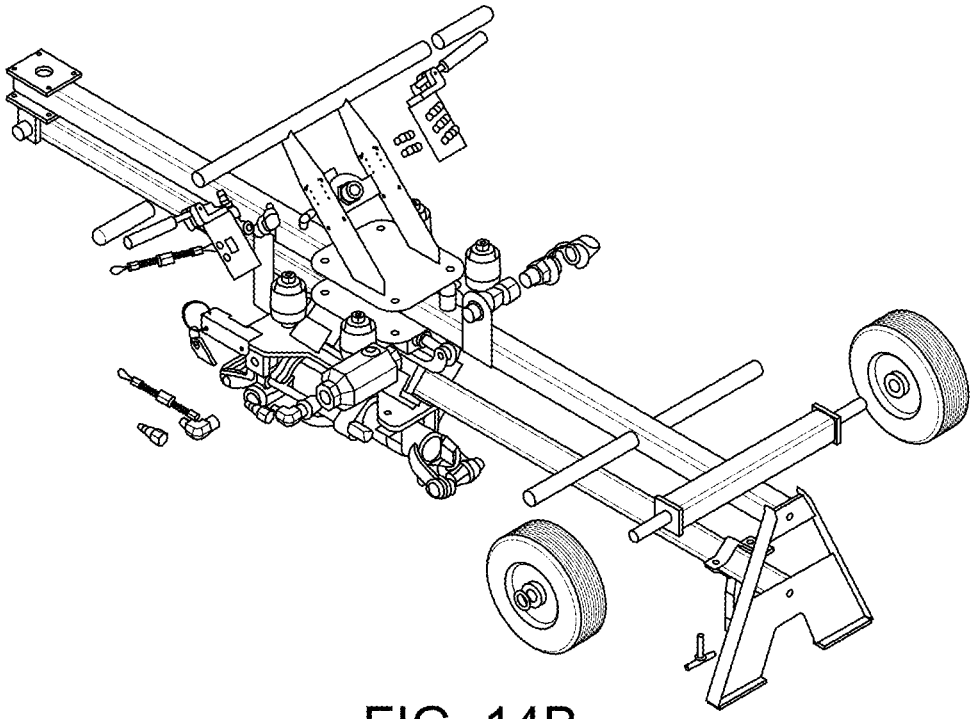
FIG. 14B (PRIOR ART)
FIG. 14*b* is an exploded isometric view of the rock drill system of FIG. 14*a*.

As mentioned above, the rock drill system includes features that reduce and/or eliminate the vibrations that resonate throughout the system during operation. FIGS. 13 and 14*a* depict an exemplary rock drill system with an anti-vibration system that interconnects the control tree 224 to the vertical frame member 202 and/or chassis. FIG. 14*b* depicts an exploded view of this same exemplary rock drill system with a vibration control system that isolates control tree 224 from the remainder of the apparatus. Generally speaking, the anti-vibration assembly generally comprises a front and rear plate, which are interconnected by one or more dampeners/isolators, which control the transmission of vibrations. These dampeners operate as shock absorbers and, by way of non-limiting example, may include commercially available springs, isolators, and systems comprising the same, as well as any number of other materials having elastomeric properties, such as rubber, thermosets, and thermoplastics, or any combination thereof.

Figure 15A:
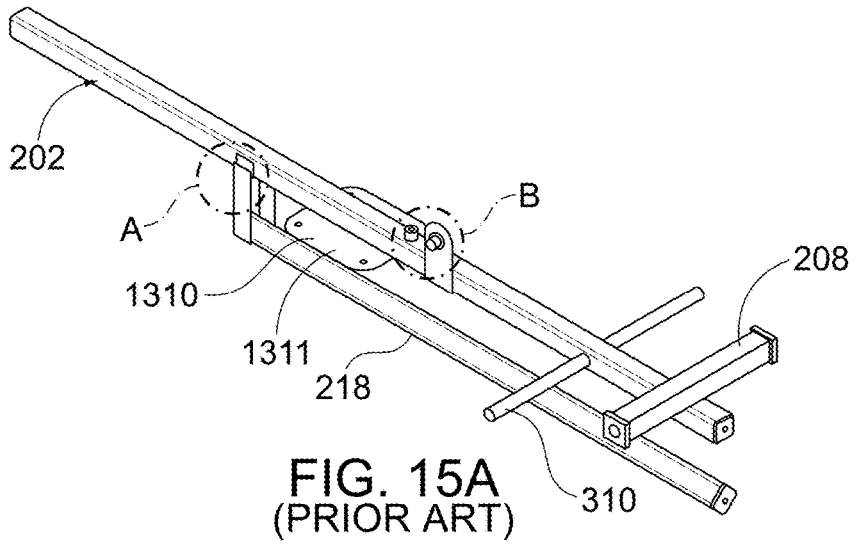
FIG. 15A (PRIOR ART)
FIGS. 15*a*-15*e* depict various views of the rock drill system's frame.
Figure 15B:
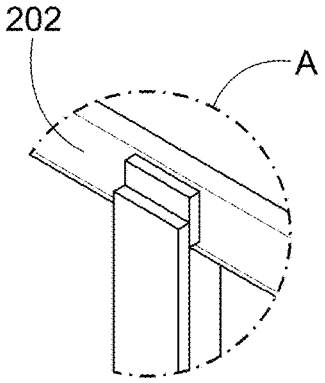
FIG. 15B (PRIOR ART)
Figure 15C:
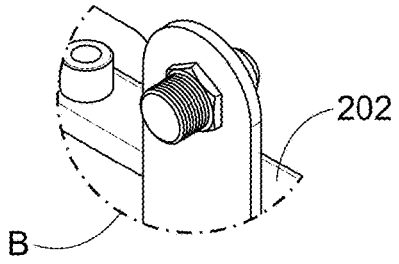
FIG. 15C (PRIOR ART)
Figure 15D:
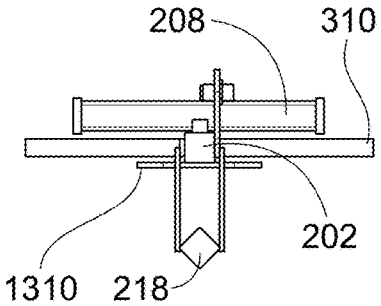
FIG. 15D (PRIOR ART)
Figure 15E:
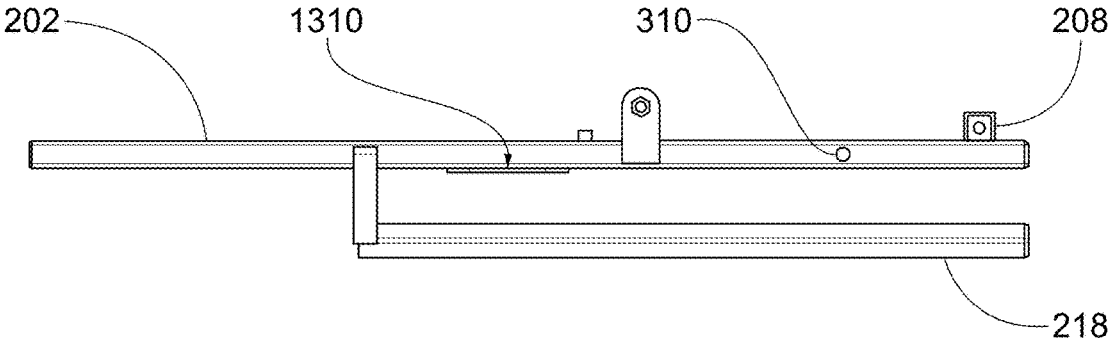
FIG. 15E (PRIOR ART)

While the Figures depict an example embodiment of an anti-vibration assembly, one skilled in the art will appreciate that different assemblies may be utilized to minimize transmission of vibration. As best illustrated in FIG. 15*a*, one embodiment of the anti-vibration assembly may comprise a rear base plate 1310 that is integrally attached or fixed to the drill side of vertical frame member 202, such that its inner surface 1311 faces the operator. It will be appreciated, however, that rear base plate 1310 may instead be fixed to the operator side of vertical frame member 202. FIGS. 15*b* and 15*c* depict enlarged views of various portions of the assembly of FIG. 15*a*, and FIGS. 15*d* and 15*e* depict side and front views, respectively, of the assembly as shown in FIG. 15*a*.

Figure 16A:
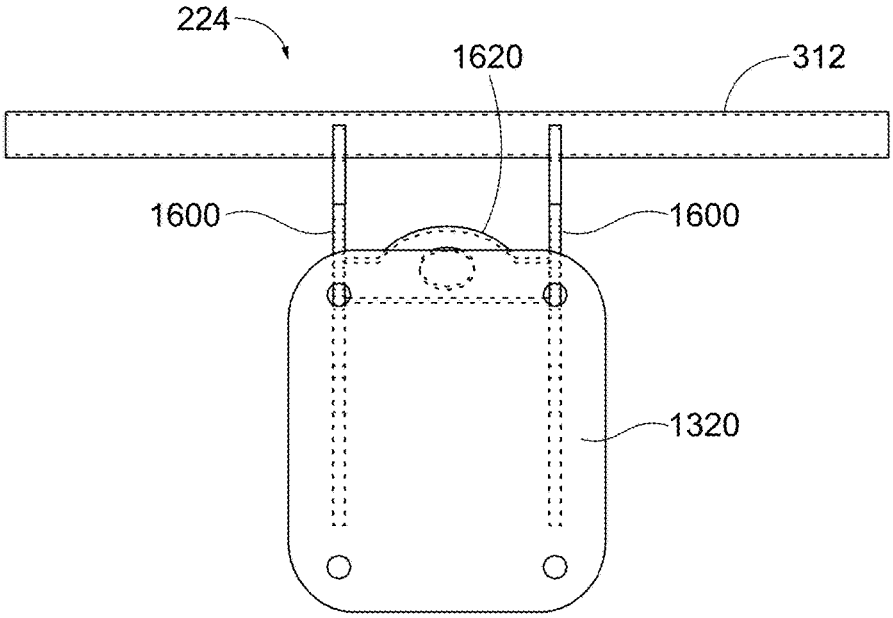
FIG. 16A (PRIOR ART)
FIGS. 16*a*-16*c* depict various views of the rock drill system's control tree.
Figure 16B:
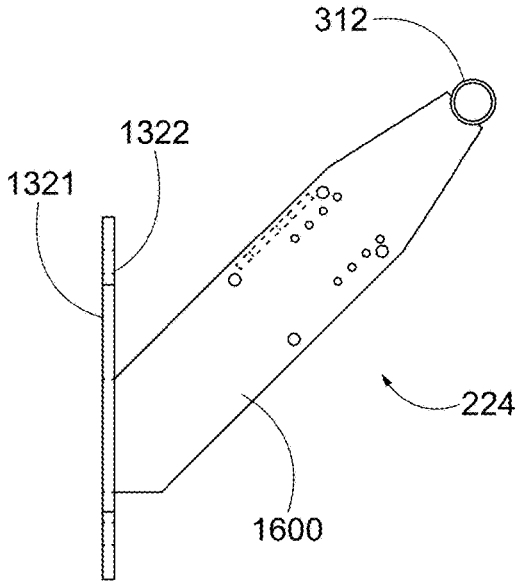
FIG. 16B (PRIOR ART)
Figure 16C:
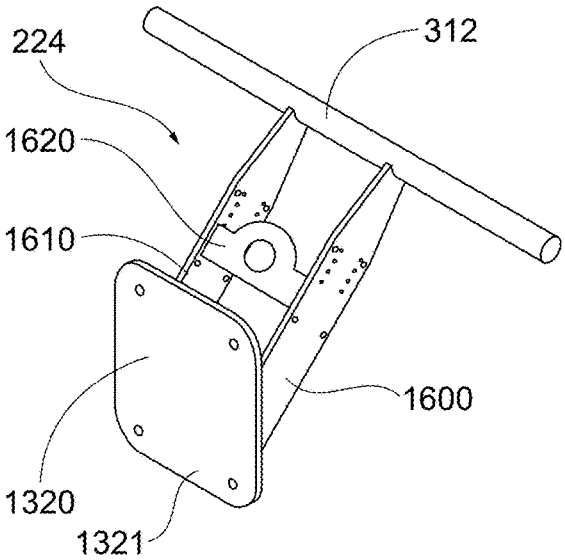
FIG. 16C (PRIOR ART)

As depicted in FIG. 16*a*, the base of the control tree 224 is integrally attached or fixed to an outer surface 1322 (see FIGS. 14*a* and 14*b*) of the front base plate 1320. FIGS. 16*b* and 16*c* depict side and front views, respectively, of the base plate 1320 and control tree 224 as shown in FIG. 16*a*. While the control tree 224 will be positioned near the upper end of the vertical frame member 202 (FIG. 15*a*), it should be appreciated that its exact location may vary depending on the operator's height. Further, the various illustrations in FIGS. 13-14*b* and 16*a*-16*c* depict an embodiment wherein control tree 224 is comprised of two parallel pillars 1600 and 1610, with a support structure 1620 positioned in between.

Figure 17A:
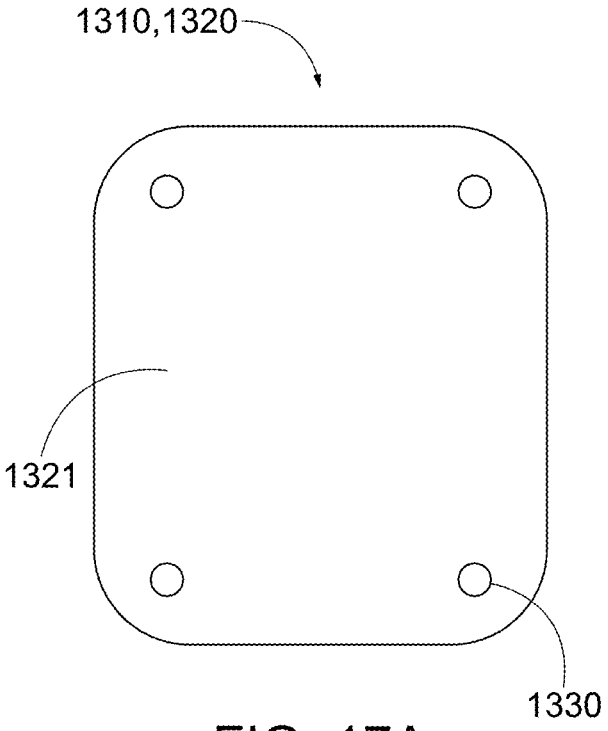
FIG. 17A (PRIOR ART)
FIGS. 17*a*-17*c* depict various views of the anti-vibration assembly's front and rear base plates.
Figure 17B:
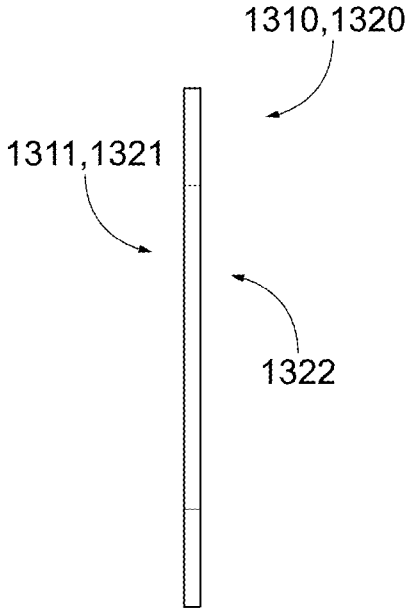
FIG. 17B (PRIOR ART)
Figure 17C:
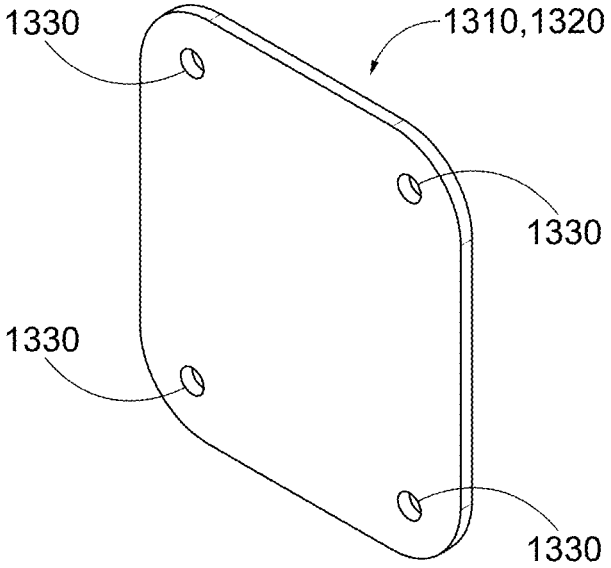
FIG. 17C (PRIOR ART)
Figure 18A:
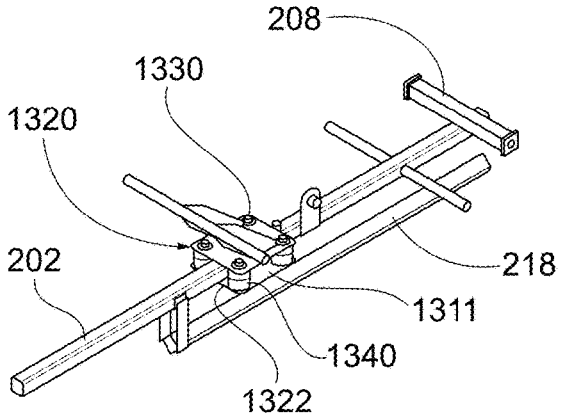
FIG. 18A (PRIOR ART)
FIGS. 18*a*-18*f* depict various views of the rock drill system's frame with the anti-vibration assembly connected thereto.
Figure 18B:
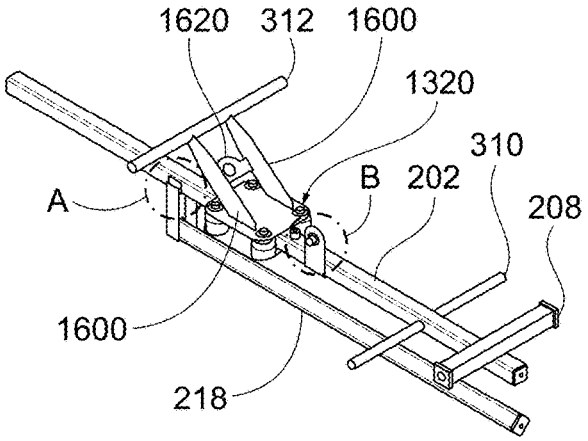
FIG. 18B (PRIOR ART)
Figure 18C:
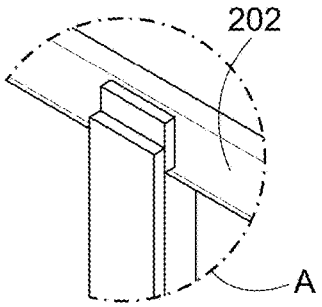
FIG. 18C (PRIOR ART)
Figure 18D:
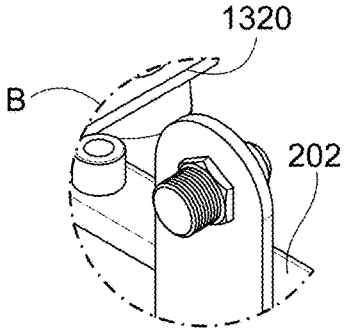
FIG. 18D (PRIOR ART)
Figure 18E:
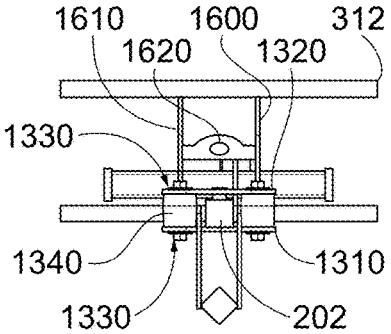
FIG. 18E (PRIOR ART)
Figure 18F:
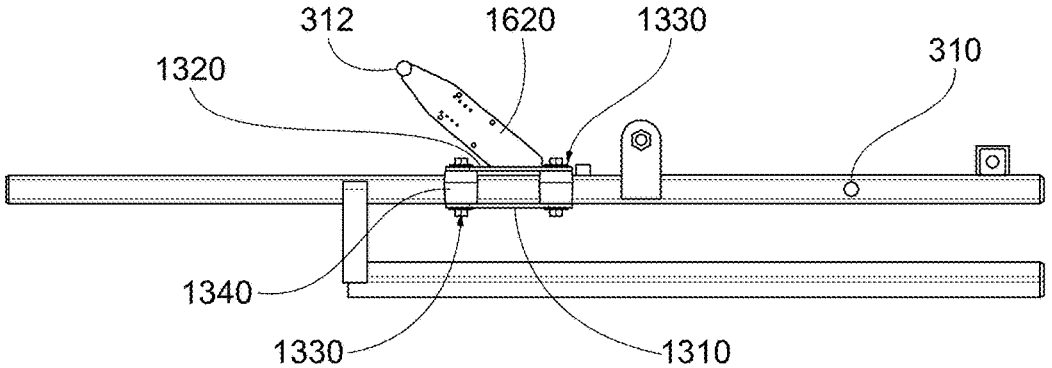
FIG. 18F (PRIOR ART)

FIGS. 17*a*-17*c* depict front, side, and isometric views, respectively, of exemplary front and rear base plates 1320 and 1310 that are identically dimensioned; however, one skilled in the art will appreciate that other base plate geometries may be utilized and, moreover, that the front and rear base plates 1320 and 1310 need not be identically dimensioned. FIGS. 17*a* and 17*c* depict front and rear base plates 1320 and 1310 each having four mounting holes 1330 positioned near each plate's four corners. However, one skilled in the art will appreciate that mounting holes 1330 may be oriented differently with respect to front and rear base plates 1320 and 1310 and, moreover, more or less than four mounting holes 1330 may be utilized.

Figure 19A:
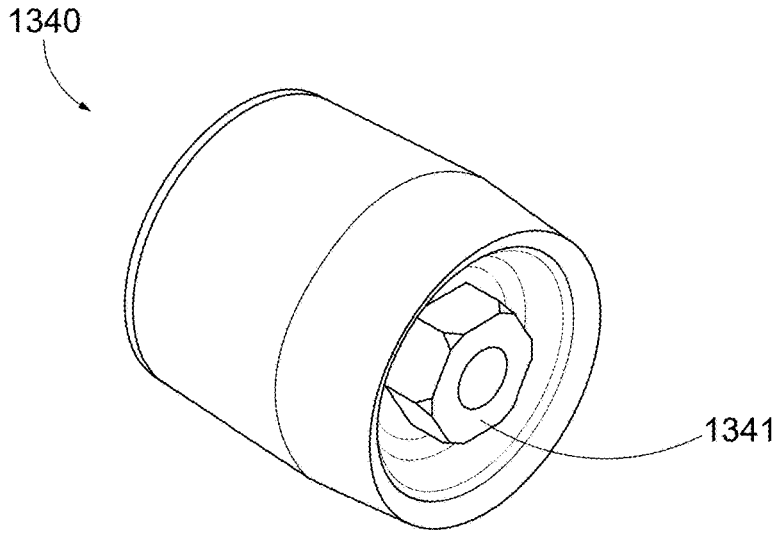
FIG. 19A (PRIOR ART)
FIGS. 19*a*-19*c* depict various views of the anti-vibration assembly's vibration isolators.
Figure 19B:
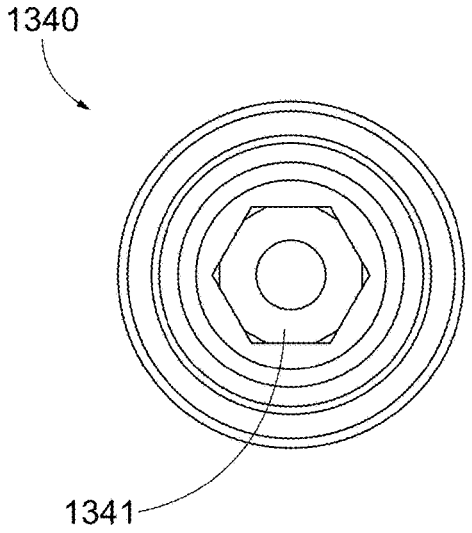
FIG. 19B (PRIOR ART)
Figure 19C:
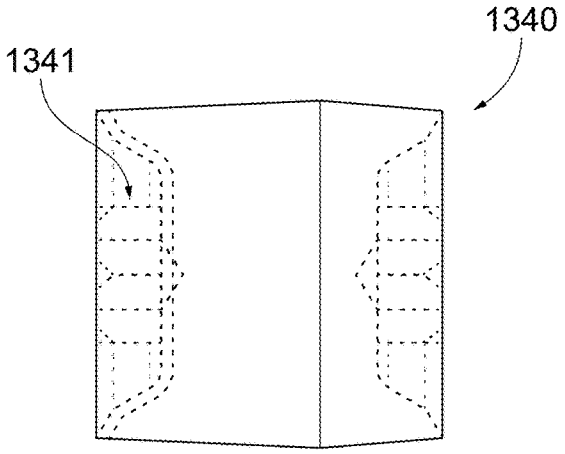
FIG. 19C (PRIOR ART)

FIGS. 18*a*-18*f* depict multiple views of the assembled anti-vibration assembly. More specifically, FIGS. 18*a*-18*f* depict the inner surface 1311 of the rear base plate 1310 being aligned with the inner surface 1322 of the front base plate 1320, such that each of their (in this example, four)

mounting holes 1330 are aligned. Once the mounting holes 1330 of the front base plate 1320 are aligned with mounting holes 1330 of the rear base plate, a dampener 1340 is secured to each mounting hole 1330 on the inner surface 1311 of rear base plate 1310. Then, the inner surface 1321 of front base plate 1320 is placed over the unattached ends of dampeners 1340 such that the mounting holes 1330 of the front base plate 1320 are aligned with the unattached ends of the dampeners 1340. Thereafter, the dampeners 1340 are secured to inner surface 1321 of the front base plate 1320. In this exemplary embodiment, four dampeners 1340 are utilized so as to correspond with each base plate's four mounting holes 1330; however, one skilled in the art will appreciate that where each of the base plates 1310 and 1320 contain more or less than four mounting holes 1330, more or less than four corresponding dampeners 1330 may be utilized to interconnect rear and front base plates 1310 and 1320. For example, where rear and front base plates 1310 and 1320 each have six mounting holes 1330, six vibration dampeners/isolators 1340 may be utilized. FIGS. 19*a*-19*c* depict an exemplary dampener 1340 that may be utilized in the anti-vibration assembly of FIGS. 13-14*b* and 18*a*-18*f*. Each dampener 1340 may comprise a fastener element 1341. It will be appreciated that other dampeners 1340 may utilize different fastening means, such as screws, bolts, etc.

Figure 20C:
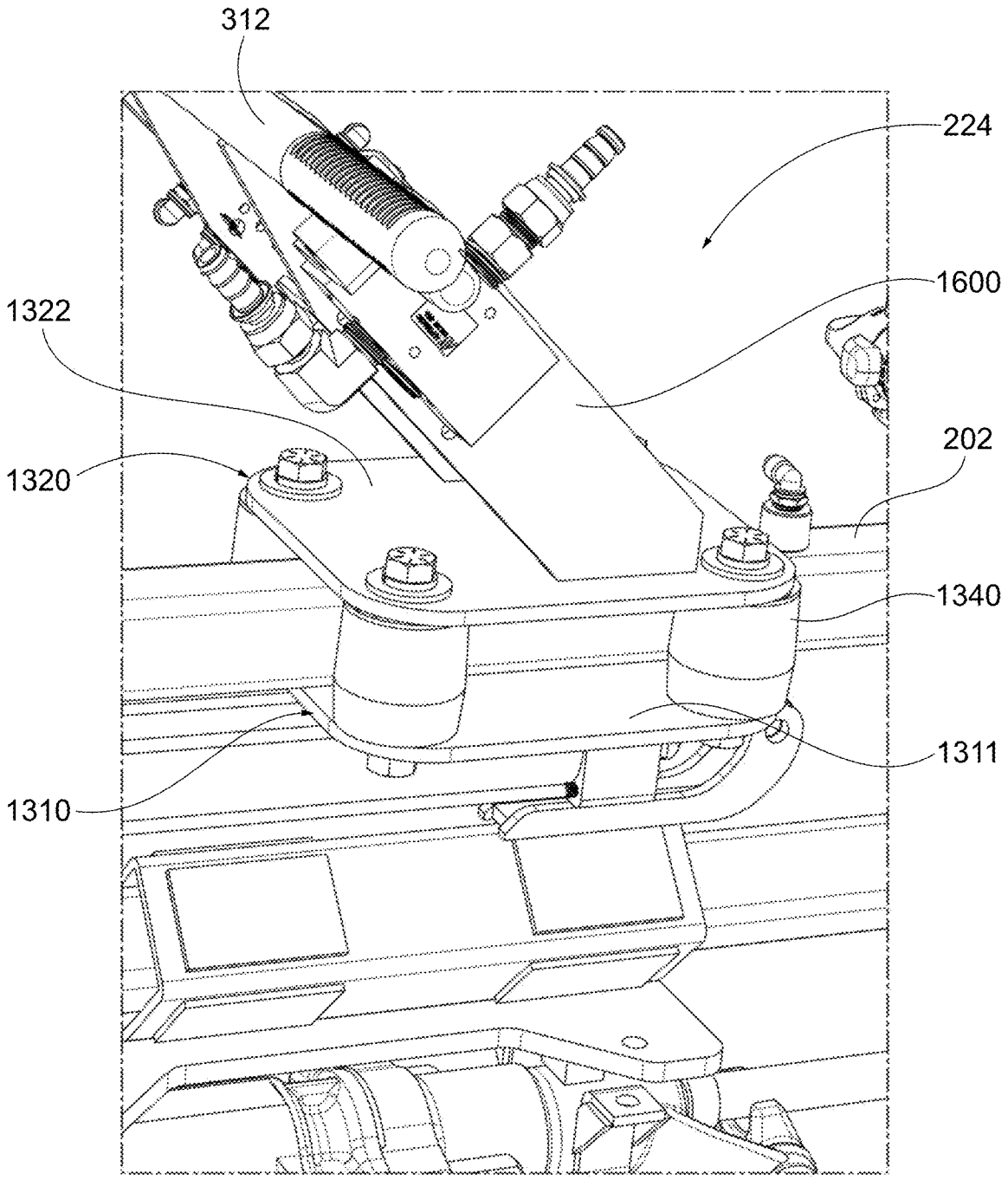
FIG. 20C (PRIOR ART)
FIG. 20C depicts a view of both the hose restraints and the anti-vibration assembly.
Figure 21:
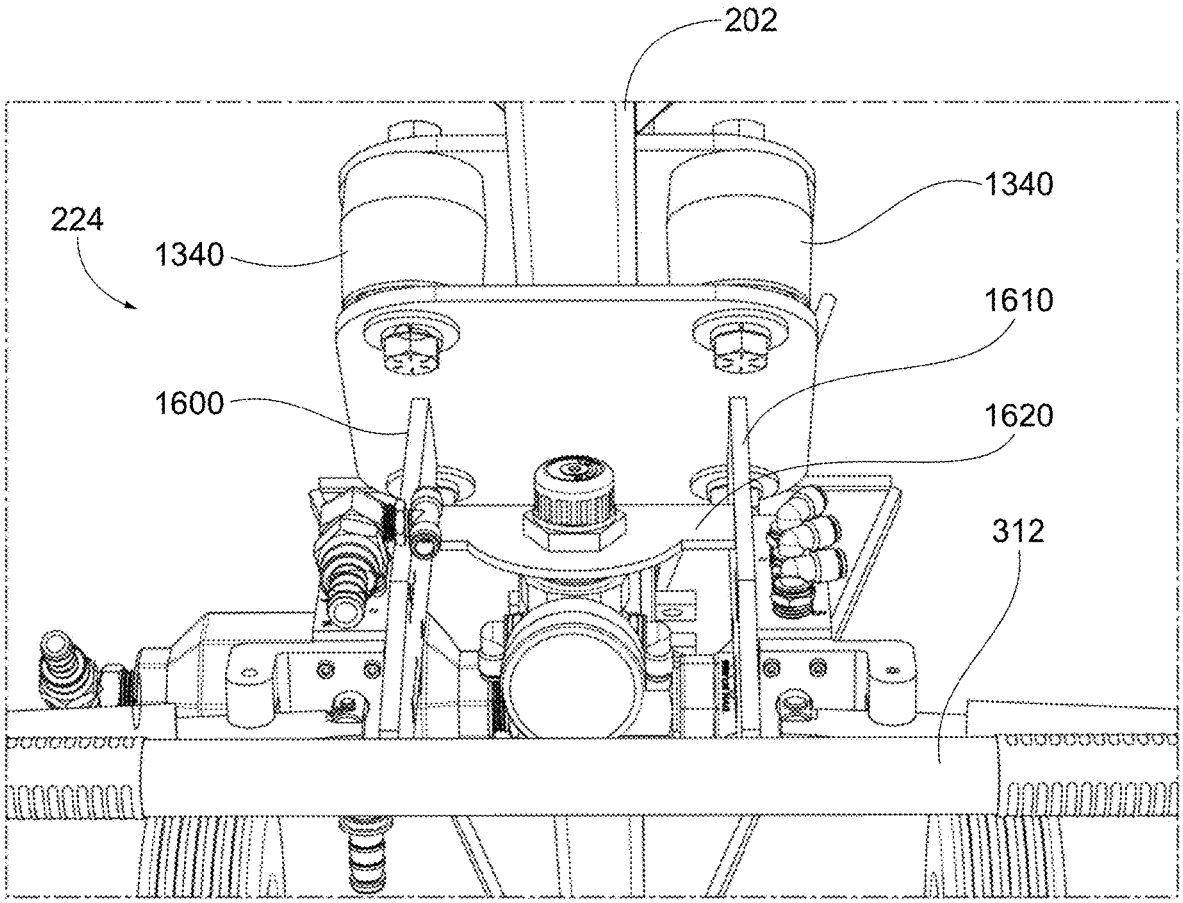
FIG. 21 (PRIOR ART)
FIG. 21 depicts a view of the rock drill system's anti-vibration assembly.

Moreover, FIGS. 20*c* and 21 depict enlarged views of the assembled anti-vibration assembly of FIGS. 18*a*-18*f*. More specifically, these illustrations depict control tree 224 being connected to the remainder of the rock drill apparatus via vibration dampeners 1340. More specifically, these figures depict an exemplary embodiment where the rear base plate 1310 is attached to the front base plate 1320 via four dampeners 1340, each of which being secured to the corresponding mounting holes 1330 of the front and rear base plates' 1320 and 1310 inner surfaces 1321 and 1311. In this exemplary embodiment, four dampeners 1340 are utilized so as to correspond to each of the base plates' 1310 and 1320 mounting holes 1330. Thus, one skilled in the art will appreciate that where each of the base plates 1310 and 1320 contain more or less mounting holes 1330, more or less than four dampeners 1330 will be utilized to interconnect base plates 1310 and 1320. For example, where base plates 1310 and 1320 each have six mounting holes 1330, six vibration dampeners/isolators 1340 will be utilized.

Figure 22:
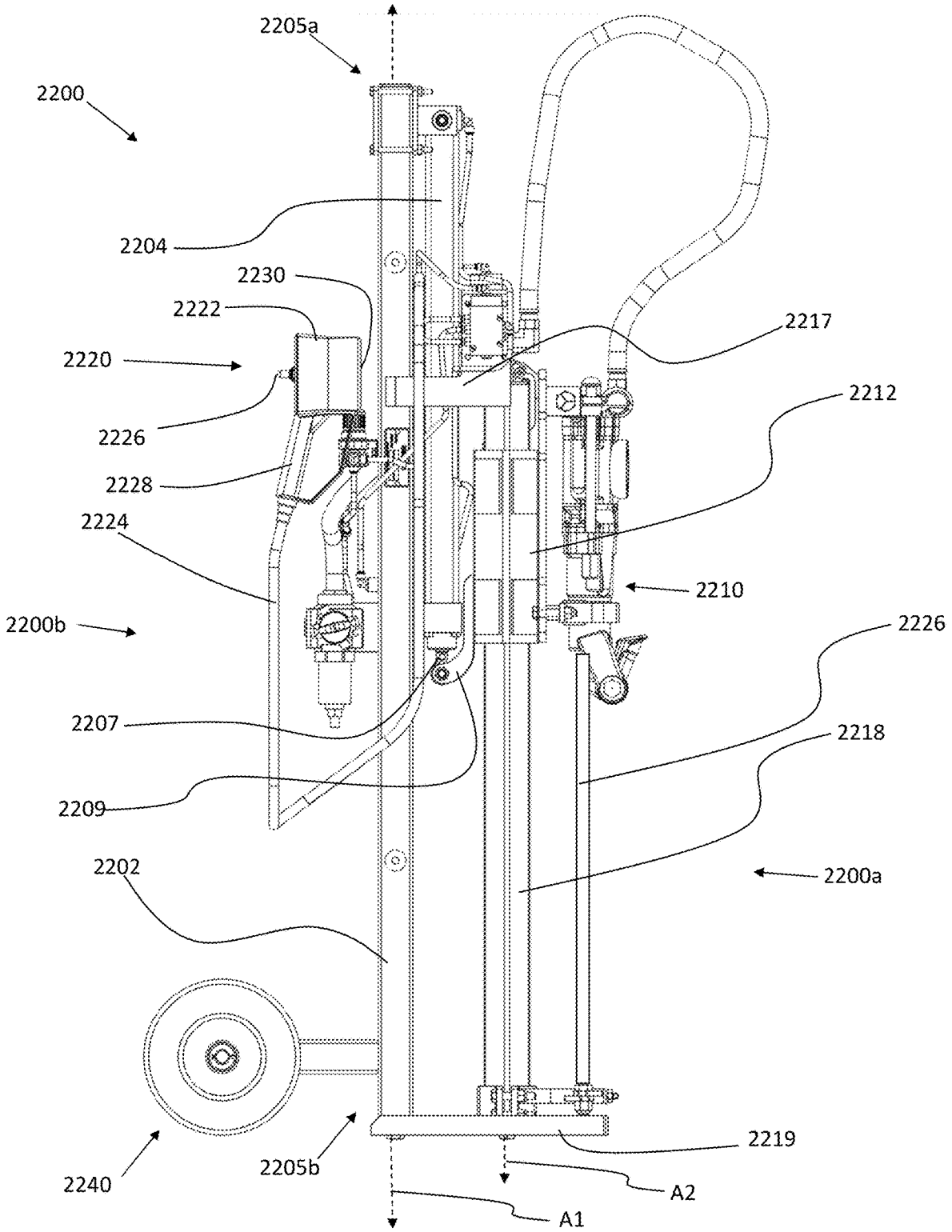
FIG. 22 depicts an alternate embodiment of the rock drill system when in a drilling position, according to one or more embodiments of the present disclosure.
Figure 23:
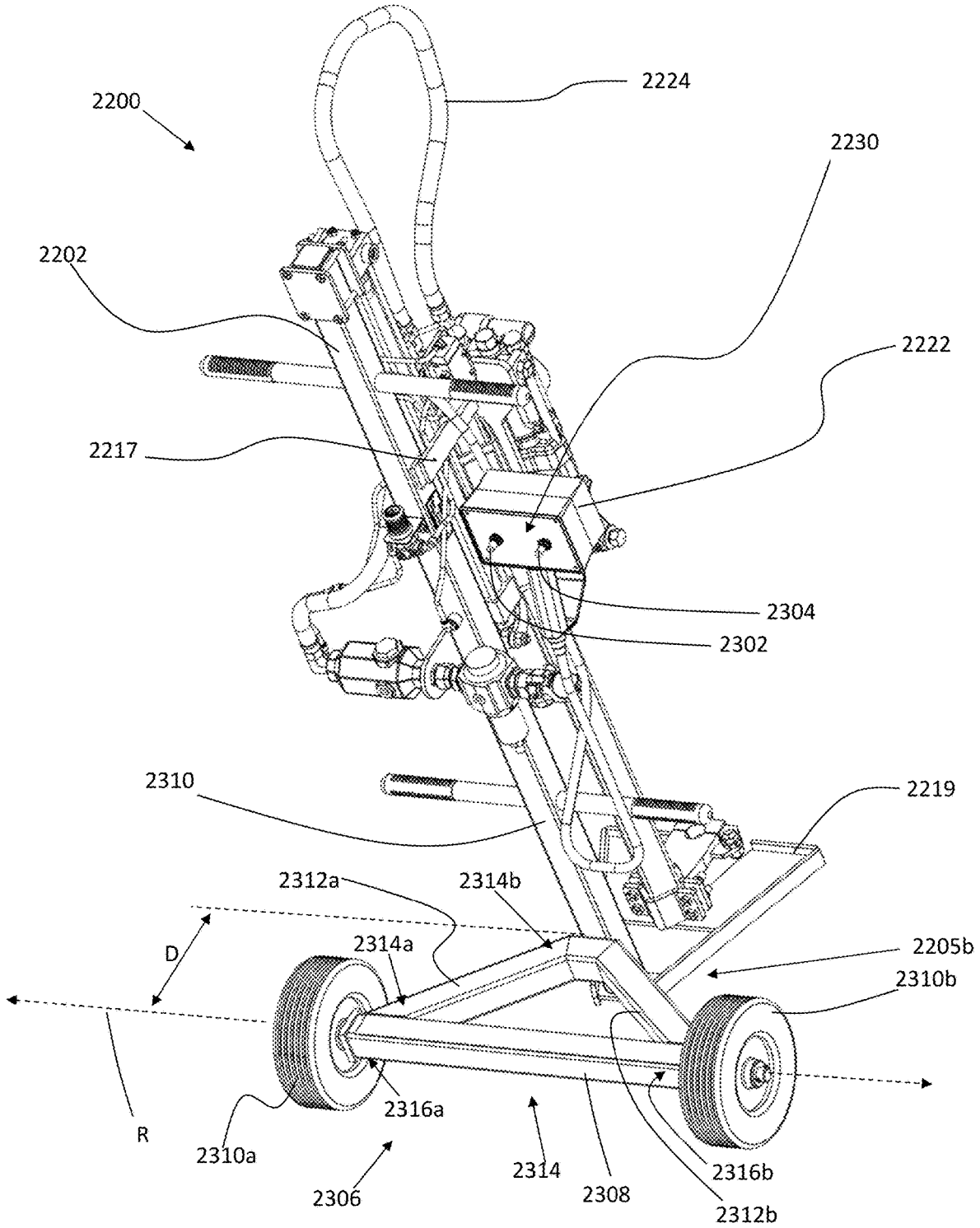
FIG. 23 is an operator side isometric view of the rock drill system of FIG. 22 when moved into the transport position or rotated position, according to one or more embodiments of the present disclosure.

When using the rock drill system described above, the operator may experience significant vibration. Even with anti-vibration assemblies installed that operate to connect the control tree 224 to the remainder of the rock drill system via dampers 1340, the operators utilizing such rock drill system are exposed to severe vibration when holding the handles 616. Such vibration may be so severe that the operator is limited to using the rock drill system for just a few hours at a time. FIGS. 22 to 23 depict an alternate embodiment of a rock drill system 2200 that is configured to allow for remote, according to one or more embodiments of the present disclosure. By allowing the operator to remotely operate the rock drill system 2200, the operator is not exposed to such harmful vibration such that the operator will be able to operate and use the rock drill system 2200 for longer periods of time without interruption and/or injury. Further, by providing a means for the operator to control and operate the rock drill system 2200 from afar, the operator will be in a better position to witness/watch operation of the rock drill system 2200 (i.e., the operator will have better visibility of the hole being drilled).

FIG. 22 is a side view of the rock drill system 2200, according to one or more embodiments of the present disclosure. As shown, the rock drill system 2200 (hereinafter, the system 2200) may include a vertical frame member 2202 having a drill side 2203*a* and an operator side 2203*b*, as well as an upper end 2205*a* and a lower end 2205*b* opposite the upper end 2205*a*. The vertical frame member 2202 may be similar to the vertical frame member 202 detailed above, and extends along a longitudinal axis A1. Also, the system 2200 may include a drill guide sleeve 2212 adapted to move axially along a longitudinal axis A2 of a drill guide shaft 2218 that is attached in a parallel orientation to the drill side 2203*a* of the vertical frame member 2202. Further, the system 2200 includes a feed cylinder 2204 that is coupled to both the drill side 2203*a* of the vertical frame member 2202 and the drill guide sleeve 2212. As described herein, the feed cylinder 2204 is operable to drive the drill guide sleeve 2212 along the longitudinal axis of the drill guide shaft 2218 relative to the vertical frame member 2202 when activated.

The system 2200 also includes a rock drill 2210 that is attached to the drill guide sleeve 2212. As mentioned above, the rock drill 2210 includes a drill rod 2226 and the rock drill 2210 is configured to cause rotation of the drill rod 2226 about an axis of rotation defined by the extension of the drill rod 2226, wherein the drill rod 2226 is operable to drill into a surface when rotated and when pressed into engagement with such surface. As mentioned above, the feed cylinder 2204 is attached to the upper end 2205*a* of vertical frame member 2202, and provides the power for the linear movement of the rock drill 2210, and the rock drill rod 226 supported thereby, along the axis of rotation of the drill rod 2226. As shown, the feed cylinder 2204 includes a plunger 2207 that is positioned at a lower end of the feed cylinder 2204 and is connected to the drill guide sleeve 2212, such that the plunger 2207 can transmit movement imparted by the feed cylinder 2204 to the drill guide sleeve 2212. Thus, the feed cylinder 2204 is operable to move the rock drill guide sleeve 2212 vertically (up and down) along the drill guide shaft 2218 via the plunger 2207 that is coupled to the drill guide sleeve 2212 via a clevis 2209, and such movement of the drill guide sleeve 2212 correspondingly moves the rock drill 2210 and the drill rod 2226 upward or downward along the axis of rotation of the drill rod 2226.

The system 2200 also includes remote control unit 2220 that is operable to control operation of the system 2200. In particular, the remote control unit 2220 is operable to activate or deactivate the rock drill 2210 to thereby activate (rotate) the drill rod 2226, and the remote control unit 2220 is operable to actuate the feed cylinder 2204 to thereby advance or retract the rock drill 2210 and the drill rod 2226 up or down. Thus, the remote control unit 2220 is operable to control the feed cylinder 2204 and/or the rock drill 2210.

In the illustrated embodiment, the remote control unit 2220 includes an enclosure 2222 and a pneumatic hose/line 2224 that operatively connects the components contained within the enclosure 2222 to the system 2200. In the illustrated embodiment, pneumatic controls 2226 are housed within the enclosure 2222 and are operable for controlling the feed cylinder 2204 for lowering or raising the rock drill 2226 and for activating or deactivating the rock drill 2226. The pneumatic controls 2226 are operatively coupled to the rock drill 2226 and the feed cylinder 2204 via the pneumatic hose 2224. Also in the illustrated embodiment, the remote control unit 2220 includes a handle 2228 connected to the enclosure 2222, such that the operator may grasp the handle 2228 when manipulating the pneumatic controls within the enclosure 2222. In embodiments, the pneumatic hose 2224 includes a plurality of pneumatic hoses extending between the enclosure 2230 and components of the system 2200, and an outer protective sheath arranged around the plurality of pneumatic hoses that protects and organizes the hoses contained therein.

The remote control unit 2220 allows the operator to control the system 2200 while being positioned away from the system 2200, such that the operator need not physically hold or grasp any handles that rigidly extend from the system 2200 to operate the system 2200. Rather, the operator need only hold the remote control unit 2220 to control the system 2200 and, therefore, the operator will not be exposed to severe vibration during operation.

To facilitate remote control of the system 2200 via the remote control unit 2220, the remote control unit 2200 is operatively coupled to the rest of the system 2200 via the pneumatic hose/line 2222, but is detachable from the remainder of the system 2200, such that the operator may grasp the remote control unit 2200 and step away from the rest of the system. In particular, the enclosure 2222 and the controls 2226 contained therein are detachable from the rest of the system 2200. For example, the enclosure 2222 may be attached to the vertical member 2202 (or another structural member, such as a handle) of the system 2200 when not in use, but then detached by the user and held by the user when operation is desired. Thus, the remote control unit 2220 is detachable and independently movable, relative to the vertical frame member 2202, between an attached position, where the remote control unit 2220 (and the enclosure 2222) is supported on the rock drill system 2200, and a detached position where the remote control unit 2220 (and the enclosure 2222) is detached from and unsupported by the rock drill system 2200. In embodiments, a magnet 2230 is utilized to detachably connect the enclosure 2222 to a portion of the system 2200. For example, the magnet 2230 may be attached to the enclosure 2222, and then the enclosure 2222 may be magnetically coupled to the vertical member 2202 (or another structural member of the system 2200, such as the drill guide shaft 2218).

The controls 2226 may be various types of devices for controlling operation of the system 2200. In embodiments, the controls 2226 comprise toggle valve switches. For example, as shown in FIG. 23, which is an operator side isometric view of the system 2200 of FIG. 22, the controls 2226 include a first toggle valve switch 2302 operatively connected to the rock drill 2210 and a second toggle valve switch 2304 operatively connected to the feed cylinder 2204. Here, the second toggle valve switch 2304 is operable to activate the feed cylinder 2204 to thereby move the rock drill 2210 (from an unengaged position) into an engaged position where the drill rod 2226 is engaging the surface to be drilled, and then the first toggle valve switch 2302 is operable to activate the rock drill 2210 and thereby cause rotation of the drill rod 2226. When the operator is finished drilling the hole, they can deactivate the rock drill 2210 via pressing or releasing the first toggle valve switch 2302, and then press the second toggle valve switch 2304 to raise the rock drill 2210 into the unengaged position, and then the operator may move the system 2200 into a new position for drilling the next hole.

The system 2200 also includes a wheel and bearing assembly 2306 provided at the lower end 2205*b* of the system 2200 and operable to allow for transport and maneuvering of the system 2200. In addition, the system 2200 includes a wheel support member 2308 that supports the wheel and bearing assembly 2306 and that extends along an axis or rotation R. As shown, the wheel and bearing assembly 2306 includes a pair of wheels 2310*a*, 2310*b* that are rotatably provided at either end of the wheel support member 2308 and operable to rotation around the axis of rotation R.

In the illustrated embodiment, the drill guide shaft 2218 is secured to the vertical frame member 2202 at the upper end 2205*a* via a drill guide shaft attachment plate 2217 and at its proximal (lower) end via a foot member 2219. The foot member 2219 rests on the bearing surface, and, together with the wheel and bearing assembly 2306, support chassis of the system 2200 when it is in an upright position. The figures depict embodiments where wheel and bearing assembly 2306 includes the two wheels 2310*a* and 2310*b* that, together with foot member 2219, form a generally three-point support structure when the chassis is in the upright position. While foot member 222 may have varying dimensions, it will be understood by one skilled in the art that a larger foot member 222 provides more stability during operation and, moreover, certain applications may have constraints that limit the maximum size of foot member 222.

As shown in FIG. 23, the wheel support member 2308 is offset from the vertical frame member 2202 so as to effectively enlarge the base of the system 2200 and thereby further enhance stability of the system 2200. As previously mentioned, prior rock drill systems detailed herein with respect to FIGS. 1A to 21 are physically supported/held by the operator during use and, due to vibrations imparted to the operator, the operator takes routine breaks when using such prior rock drill systems to limit the amount of vibration exposed to the operator. With the system 2200, however, the operator is able to control and operate the system 2200 from afar (e.g., 15 feet away) via the remote control unit 2220; and, when remotely controlling the system 2200 in that manner, the operator will not be physically supporting the system 2200 as is the case with prior rock drill systems. Offsetting the wheel support member 2308 from the vertical frame member 2202 further enhances stability of the system, as compared to the prior rock drills, by effectively enlarging the base area of the system 2200 that contacts the ground.

In the illustrated embodiment, the wheel support member 2308 is offset from the vertical frame member 2202 by a distance D, such that the axis or rotation R is spaced apart from a surface 2310 of the vertical frame member 2202 by the distance D. In embodiments, the distance D is about 8 inches. In other embodiments, the distance is at least 8 inches, or at least 10 inches or at least 6 inches.

The system 2200 includes an extension member 2312 that interconnects the wheel support member 2308 to the vertical frame member 2202. In the illustrated embodiment, the extension member 2312 is a pair of extension members 2312*a* and 2312*b*. Here, the pair of extension members 2312*a* and 2312*b* and the wheel support member 2308 all together define a triangular footprint 2314. Each of the extension members 2312*a* and 2312*b* includes an operator end 2314*a* and a drill end 2314*b* and the wheel support member includes opposite side ends 2316*a* and 2316*b* at which the wheels 2310*a*, 2310*b* are rotatably connected, and the operator end 2314*a* of a first of the pair of extension members 2312*a* is connected to a first of the opposite side ends 2316*a* of the wheel support member 2308, and the operator end 2314*a* of a second of the pair of extension members 2312*b* is connected to a second of the opposite side ends 2316*b* of the wheel support member 2308.

When unused, the system 2200 may rest in its upright position (aka the drilling position), as shown in FIG. 22, with the wheels 2310*a* and 2310*b* and the lower surface of the foot member 2219 in contact with the ground surface and stabilizing the system 2200. When the operator desires to use the system 2200, they may rock the system 2200 back into a rotated position (aka the transport position), as shown in FIG. 23, such that the operator may move or relocate the system 2200 to the location where a hole needs to be drilled via the rock drill 2210. Then, the operator may position the system 2200 back into the upright position, grasp the remote control unit 2220 and move away from the system 2200, and activate the feed cylinder 2204 and the rock drill 2210 via the remote control unit 2220. After use, the operator may deactivate the rock drill 2210 and activate the feed cylinder 2204 to reposition the rock drill 2210, and then move the system 2200 to another location for use or storage, as discussed above. Thus, during use of the system 2200, the operator may place their foot on the wheel support member 2308 to help facilitate orienting the system 2200 into the rotated transport position where it may be wheeled to various locations. To facilitate the operator rocking the system 2200 into the non-vertical transport position, a non-slip coating may be applied to an exterior surface of the wheel support member 2308, such that the operator's foot is inhibited from slipping when being placed on the wheel support member 2308 to aid in rocking the system 2200 into the transport position.

While the invention has been described with reference to preferred embodiments, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Since certain changes may be made in the above compositions and methods without departing from the scope of the invention herein involved, it is intended that all matter contained in the above descriptions and examples or shown in the accompanying drawings shall be interpreted as illustrative and not in a limiting sense. In this application all units are in the metric system and all amounts and percentages are by weight, unless otherwise expressly indicated. Also, all citations referred herein are expressly incorporated herein by reference. All terms not specifically defined herein are considered to be defined according to Webster's New Twentieth Century Dictionary Unabridged, Second Edition. The disclosures of all of the citations provided are being expressly incorporated herein by reference. The disclosed invention advances the state of the art and its many advantages include those described and claimed.

I claim:

1. A rock drill system comprising:

a vertical frame member having a drill side and an operator side;

a drill guide sleeve adapted to move axially along a longitudinal axis of a drill guide shaft that is attached in a parallel orientation to the drill side of the vertical frame member;

a feed cylinder that is coupled to both the drill side of the vertical frame member and the drill guide sleeve, wherein the feed cylinder drives the drill guide sleeve along the longitudinal axis of the drill guide shaft relative to the vertical frame member;

a rock drill that is attached to the drill guide sleeve and including a drill rod;

a foot member supporting the vertical frame member and the drill guide shaft and including a cutout for receiving the drill rod;

a wheel support member;

an extension member extending between the wheel support member and the vertical frame member, such that the wheel support member is offset from the vertical frame member via the extension member;

a wheel and bearing assembly supported on the wheel support member; and a remote control unit operatively connected to the feed cylinder and the rock drill such that the remote control unit is operable to control the feed cylinder and/or the rock drill, wherein the remote control unit is removable from and independently movable relative to the vertical frame member, the feed cylinder, and the rock drill, wherein the remote control unit includes a magnet operable to attach the remote control unit to the vertical frame member.

2. The rock drill system of claim 1, wherein the extension member extends horizontally away from the vertical frame member such that the wheel support member is horizontally offset from the vertical frame member.

3. The rock drill system of claim 1, wherein the extension member includes a pair of extension members.

4. The rock drill system of claim 3, wherein the pair of extension members and the wheel support member define a triangular footprint.

5. The rock drill system of claim 3, wherein each of the extension members includes an operator end and a drill end and the wheel support member includes opposite side ends, wherein the operator end of a first of the pair of extension members is connected to a first of the opposite side ends of the wheel support member, and the operator end of a second of the pair of extension members is connected to a second of the opposite side ends of the wheel support member.

6. The rock drill system of claim 1, wherein the wheel support member is spaced 8 inches from the operator side of the vertical frame member via the extension member.

7. The rock drill system of claim 1, further comprising a non-slip coating applied to an exterior surface of the wheel support member.

8. The rock drill system of claim 1, wherein the wheel support member and the wheel and bearing assembly are provided on the operator side of the vertical frame member.

9. The rock drill system of claim 1, wherein remote control unit is operatively coupled to the feed cylinder and the rock drill via a pneumatic line.

10. The rock drill system of claim 9, wherein remote control unit includes a toggle valve operable to control the feed cylinder and/or the rock drill.

11. The rock drill system of claim 1, wherein the remote control unit is detachable from the rock drill system and movable between an attached position, where the remote control unit is supported on the rock drill system, and a detached position where the remote control unit is detached from and unsupported by the rock drill system.

12. A rock drill system comprising:

a vertical frame member having a drill side and an operator side;

a drill guide sleeve adapted to move axially along a longitudinal axis of a drill guide shaft that is attached in a parallel orientation to the drill side of the vertical frame member;

a feed cylinder that is coupled to both the drill side of the vertical frame member and the drill guide sleeve, wherein the feed cylinder drives the drill guide sleeve along the longitudinal axis of the drill guide shaft relative to the vertical frame member;

a rock drill that is attached to the drill guide sleeve;

a remote control unit operatively connected to the feed cylinder and the rock drill such that the remote control unit is operable to control the feed cylinder and/or the rock drill, wherein the remote control unit is detachable from the rock drill system and movable between an attached position, where the remote control unit is supported on the rock drill system, and a detached position where the remote control unit is detached from and unsupported by the rock drill system; and wherein the remote control unit includes a magnet operable to attach the remote control unit to the vertical frame member in the attached position.

13. The rock drill system of claim 12, wherein the remote control unit is operatively coupled to the feed cylinder and the rock drill via a pneumatic line.

14. The rock drill system of claim 13, wherein the remote control unit includes a toggle valve operable to control the feed cylinder and/or the rock drill.

15. The rock drill system of claim 12, further comprising:

a wheel support member offset from the vertical frame member; and a wheel and bearing assembly supported on the wheel support member.

16. The rock drill system of claim 15, further comprising a pair of extension members interconnecting the wheel support member and the vertical frame member, wherein:

each of the extension members includes an operator end and a drill end and the wheel support member includes opposite side ends, wherein the operator end of a first of the pair of extension members is connected to a first of the opposite side ends of the wheel support member, and the operator end of a second of the pair of extension members is connected to a second of the opposite side ends of the wheel support member; and the pair of extension members and the wheel support member define a triangular footprint.

17. A rock drill system comprising:

a vertical frame member having a drill side and an operator side;

a drill guide sleeve adapted to move axially along a longitudinal axis of a drill guide shaft that is attached in a parallel orientation to the drill side of the vertical frame member;

a feed cylinder that is coupled to both the drill side of the vertical frame member and the drill guide sleeve, wherein the feed cylinder drives the drill guide sleeve along the longitudinal axis of the drill guide shaft relative to the vertical frame member;

a rock drill that is attached to the drill guide sleeve;

a wheel support member;

an extension member extending between the wheel support member and the vertical frame member, such that the wheel support member is offset from the vertical frame member;

a wheel and bearing assembly supported on the wheel support member; and a remote control unit operatively connected to the feed cylinder and the rock drill such that the remote control unit is operable to control the feed cylinder and/or the rock drill, wherein the remote control unit is detachable from the rock drill system and movable between an attached position, where the remote control unit is supported on the rock drill system, and a detached position where the remote control unit is detached from and unsupported by the rock drill system, wherein the remote control unit includes a magnet operable to attach the remote control unit to the vertical frame member.

* * * * *